US007590376B2

(12) United States Patent
Tomita et al.

(10) Patent No.: US 7,590,376 B2
(45) Date of Patent: Sep. 15, 2009

(54) FIXING METHOD, A FIXING APPARATUS, AN IMAGE FORMATION METHOD, AND AN IMAGE FORMATION APPARATUS

(75) Inventors: Kunihiko Tomita, Kanagawa (JP); Naoki Iwata, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 478 days.

(21) Appl. No.: 11/333,435

(22) Filed: Jan. 18, 2006

(65) Prior Publication Data

US 2006/0171749 A1 Aug. 3, 2006

(30) Foreign Application Priority Data

Jan. 26, 2005 (JP) ..... 2005-017669
Sep. 30, 2005 (JP) ..... 2005-285912
Oct. 27, 2005 (JP) ..... 2005-313328

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS 3,948,215 A 4/1976 Namiki
6,118,955 A * 9/2000 Yoneda et al. ..... 399/69
6,370,350 B2 4/2002 Tomita
6,370,352 B1 4/2002 Tomita
6,413,690 B2 7/2002 Tomita
6,455,217 B2 9/2002 Tomita
6,492,084 B2 12/2002 Tomita
6,505,016 B2 1/2003 Tomita
6,519,439 B2 2/2003 Tomita
6,566,026 B2 * 5/2003 Watanabe et al. ..... 430/110.1
6,623,897 B2 9/2003 Tomita
6,778,788 B2 8/2004 Tomita et al.
6,939,614 B2 9/2005 Tomita
2003/0059224 A1 3/2003 Tomita et al.
2003/0207194 A1 11/2003 Tomita
2004/0179875 A1 9/2004 Iwata et al.
2005/0232664 A1 10/2005 Tomita

FOREIGN PATENT DOCUMENTS

JP 51-29825 8/1976
JP 63-262671 10/1988
JP 5-19646 1/1993
JP 10-221982 8/1998
JP 11-2984 1/1999
JP 2000-89593 3/2000

(Continued)

*Primary Examiner*—David M Gray
*Assistant Examiner*—Bryan P Ready
(74) *Attorney, Agent, or Firm*—Oblon, Spivak, McClelland, Maier & Neustadt, L.L.P.

(57) ABSTRACT

An energy-saving fixing apparatus for use in image formation apparatuses such as a copying machine is disclosed.

A recording medium is sandwiched by a pair of belts, having belt tension between 0.001 and 5.4N/mm, for a period between 50 and 1000 ms. The recording medium is pressurized at pressure between 0.007 and 2.7 Ns/mm by a nip constituted by a heating roller and a pressurizing roller. The recording medium is conveyed with its toner image carrying side being adhered to one of the belts without being cooled.

66 Claims, 11 Drawing Sheets

FOREIGN PATENT DOCUMENTS

| | | |
|---|---|---|
| JP | 2000-220632 | 8/2000 |
| JP | 2000-235320 | 8/2000 |
| JP | 2000-330402 | 11/2000 |
| JP | 2001-42678 | 2/2001 |
| JP | 2001-345169 | 12/2001 |
| JP | 2002-221866 | 8/2002 |
| JP | 2004-86090 | 3/2004 |
| JP | 2004-252348 | 9/2004 |

* cited by examiner

FIXING METHOD, A FIXING APPARATUS, AN IMAGE FORMATION METHOD, AND AN IMAGE FORMATION APPARATUS

BACKGROUND OF THE INVENTION

1. Field of the Invention

The present invention relates to image fixing employed by electrophotographic image formation apparatuses such as a copying machine, a printer, and a facsimile apparatus, and especially relates to a fixing method, a fixing apparatus, an image formation method, and an image formation apparatus that realize energy savings of thermal fixing a toner image to a recording medium.

2. Description of the Related Art

In recent years and continuing, resource and energy conservation are increasingly required for environmental protection of the earth. In electrophotography, R&D are advancing in order to reduce power consumption for energy savings, especially in the field of thermal fixing technology that requires intensive power consumption. At present, fixing temperatures ranging about 150° C. to 200° C. are commonly used, and starting time from the room temperature of a fixing apparatus takes about 1 to 5 minutes. It is desired that the temperature be reduced to 150° C. or less, preferably about 100° C. for energy savings, and the starting time be shortened.

There are various approaches to realize energy savings. One of the approaches is reducing the power consumption when transporting a recording medium. In order to realize this, an important point is lowering the melting point of toner. Namely, the softening point or the melting point of the toner should be reduced to 100° C. or less in order to realize fixing at a lower temperature. However, as for a given kind of organic high polymer, if the melting point is reduced, the fusion viscosity of the toner will be reduced. The reason for this is considered to be because the melting point of resin is dependent on molecular weight, tangles of molecule chains become loose if molecular weight is low, interaction becomes weak, and the fusion viscosity falls. Accordingly, when the melting point of the toner is low, the viscosity rapidly decreases at a temperature higher than the melting point. For this reason, the effective rubber margin (temperature region of the toner showing characteristics of rubber) becomes narrow and the toner on the recording medium tends to be offset toward a heating object for fixing. Then, it is conceivable that the contact time of a fixing surface contacting the toner be lengthened so that heat may fully get across to the toner at the time of fixing. In order to realize this with an apparatus with a usual roller fixing method, a technology is known whereby the diameters of a fixing roller and a pressurization roller (the rollers) are increased such that the time of the toner contacting the fixing surface can be lengthened by deformation of a rubber surface of the pressurization roller at the time of pressurization.

However, since the diameters of the rollers are enlarged, the size of the fixing apparatus becomes large. In order to solve this, a belt is wound around the heating roller such that adhesion time is increased. However, the problem with this approach is that the starting time is increased due to the mass of the rollers and the mass of an auxiliary roller, i.e., the starting time becomes long.

In general, thermal fixing is carried out by bonding a toner image imprinted on the recording medium, such as paper, by heating and pressurizing such that the toner is fused and bonded to the recording medium that is sandwiched by the heating roller and the pressurization roller. In this way, heat is transferred from the heating roller to the toner and the recording medium. However, since there is a limit in the width of the nip constituted by the heating roller and the pressurization roller, heating time is sharply limited. The higher the temperature of the heating roller is, i.e., the greater the heat slope (difference between the temperature of the heating roller and the environmental temperature) is, the quicker a greater quantity of heat flows from the heating roller to the toner and the recording medium.

However, if the temperature is high and a great amount of heat is transferred to the recording medium, energy consumption inevitably increases. This is not desirable from the viewpoint of energy savings. Although the nip width constituted by the heating roller and the pressurization roller may be enlarged by increasing the amount of deformation of the rubber and sponge of the pressurization roller by lowering the hardness such that a longer heating time be obtained in the case of the fixing apparatus using the rollers, there is a limit in extending the heating time due to the curvature of the rollers. That is, if the radius of curvature of the rollers is increased, a greater nip width becomes available; however, the heating roller of the increased diameter requires an excessively great heat capacity, and energy consumption is increased by the increase of heat dissipation area. Accordingly, the time for the temperature to rise increases.

With these limitations, roller fixing is often carried out by raising the temperature of the heating roller to a temperature beyond necessity in order to raise the temperature of the toner to a predetermined temperature within a short time corresponding to the limited nip width. In this case, since the temperature of the toner has to be raised to the melting point of the toner, the temperature of the heating roller is made high. The high temperature raises the surface temperature of the recording medium, such as paper. Further, since the heat slope is great, the temperature inside the recording medium is raised beyond necessity.

That is, in the case of roller fixing wherein only a small nip width is available, the temperature of the heating roller has to be raised beyond necessity, there is excessive heat dissipation due to the great heat slope of the roller as compared with the environment, and there is excessive transfer of the heat from the heating roller to the recording medium due to the high temperature of the heating roller. For this reason, the problem is in that excessive energy consumption occurs and the time for the temperature rise of the roller is long.

In order to solve the problem, it is conceivable that a fixing belt be used. In this case, the heat of the fused toner is dissipated for solidifying, and then the recording medium is separated from the fixing belt, thereby preventing the offset of the toner image from occurring. That is, the recording medium is heated through the fixing belt from the heating object for a long time. This method requires a low temperature compared with the roller fixing method; however, this method requires that the recording medium be heated for a long time such that the toner reaches the predetermined temperature. It takes a long time because the heating object provides a low temperature compared with the roller fixing method, producing a small heat slope, and taking a long time for the toner on the recording medium to reach the predetermined temperature.

According to this method, it is not necessary to raise the temperature beyond necessity and energy savings can be attained as compared with the roller fixing method that requires a temperature higher than the temperature at which the toner can be fixed. That is, since the recording medium is continuously heated at a low temperature while passing the heating section, although it takes a long time for the toner to reach the predetermined temperature, the toner on the recording medium can reach the same temperature as in the case of roller fixing. Further, since the temperature of the heating object at this time is low and the heat slope between the environment and the heating object is small, the heat dissipation becomes small, and since the temperature is low, the heat slope between the recording medium and the heating object is also small, and the total heat that the recording medium receives also becomes small.

While, indeed, fixing is carried out at a low temperature according to this method, another problem arises. That is, this method requires additional drive rollers, etc., increasing the mass of members that are to be heated, which in turn makes the temperature rising time of the fixing apparatus longer than the roller fixing method.

Further, since the toner image that has been solidified with heat having been dissipated is stuck to the surface of the belt, the recording medium tends to roll (curl) around the belt at a discharge section. In order to prevent the recording medium from rolling (curling), a separation nail, and the like, is often provided such that the separation nail hooks a tip of the recording medium for separating from the belt. When there is an image at the tip of the recording medium, there is a problem in that a scratch is produced.

According to Patent Reference 1, a cooling fan that is connected to a duct is provided for supplying fresh air to the surface of the belt that is wound around the fixing roller such that the toner in a fusion state is cooled and solidified on the recording medium and the offset is prevented from occurring. In the case of this technology, problems are that the recording medium tends to float while being conveyed, and the image tends to blur.

A system according to Patent Reference 2 includes a fixing belt that is wound around two or more rollers, and a heating unit, wherein guide rollers are prepared at the forward tip, rear tip and in-between of the conveyance passage of the recording paper so that the recording medium is conveyed being pressed down with its image side contacting the fixing belt. In this case, the problem is in that the recording medium tends to float at a portion where there are no guide rollers, and the image becomes blurred.

According to Patent Reference 3, an endless fixing belt is wound around a heating roller, a fixing roller, and a pressurization roller that contacts and pressurizes the fixing belt from underneath, wherein the fixing roller and the heating roller contact the pressurization roller constituting a nip between the rollers. In this case, image blur due to transporting the recording paper through a high curvature of the fixing nip is a problem.

Another approach to save energy is shortening the temperature rising time, the time being required until a fixing apparatus becomes ready to operate. In this approach, a user waiting time serves as an important element. That is, if the user waiting time should be short, the temperature of the fixing roller has to be maintained at a given temperature (standby temperature), which requires continuous and considerable power consumption while the fixing apparatus is not in use. Accordingly, if the temperature rising time can be made short without continuously supplying the power, it results in energy savings. However, as described above, the increase in the time of the toner contacting the fixing surface has a result opposite to shortening the temperature rising time until the fixing apparatus becomes usable.

According to a publicly known technology, a recording medium is supported by a pair of belts, and the recording medium is separated after the toner is cooled and solidified. In this way, hot offset is prevented from occurring (for example, Patent Reference 4). However, heat should be fully transferred for fixing, and if the toner is cooled, its performance is degraded. Furthermore, cooling the belts and the recording medium means throwing energy away, which is counter to energy savings.

In addition, the conventional technologies include a fixing apparatus and a fixing method wherein the temperature is maintained by sandwiching the recording medium between a pair of belts (for example, Patent Reference 5), an apparatus wherein the tension of a belt is considered (for example, Patent Reference 6), an apparatus wherein the time for the recording medium to pass a nip is considered (for example, Patent Reference 7), an apparatus wherein pressure within a nip constituted by a heating roller and a pressurization roller is considered (for example, Patent Reference 8), and an apparatus wherein diameters of a heating roller and a pressurization roller are considered (for example, Patent-Reference 9).

[Patent reference 1] JPA 5-019646
[Patent reference 2] JPA 10-221982
[Patent reference 3] JPA 2000-89593
[Patent reference 4] JP 51-29825
[Patent reference 5] JPA 2002-221866
[Patent reference 6] JPA 2000-330402
[Patent reference 7] JPA 2001-042678
[Patent reference 8] JPA 2000-235320
[Patent reference 9] JPA 11-002984
[Patent reference 9] JPA 2001-345169
[Patent reference 10] JPA 2002-221866
[Patent reference 11] JPA 2004-086090
[Patent reference 12] JPA 2004-252348
[Patent reference 13] JPA 2000-220632
[Patent reference 14] JPA 63-262671

SUMMARY OF THE INVENTION

The present invention provides a fixing method, a fixing apparatus, an image formation method, and an image formation apparatus that may substantially obviate one or more of the problems caused by the limitations and disadvantages of the related art.

In order to solve the problems described above, a preferred embodiment of the present invention provides a fixing apparatus used by an image formation apparatus, such as a copying machine, wherein power consumption of the fixing apparatus and the image formation apparatus as a whole is reduced by reduction of power consumption when in operations (the recording medium being transported and fixing being carried out) and by suspending power supply to the fixing apparatus while in stand-by.

Further, an embodiment of the present invention provides a fixing apparatus and an image formation apparatus therewith, wherein the fixing apparatus uses low temperature toner, achieving energy savings, stably separates the recording medium even when an image is printed all over the recording medium such as in the case of a color photograph, and prevents the recording medium from curling when being discharged.

Features of the present invention are set forth in the description that follows, and in part will become apparent from the description and the accompanying drawings, or may be learned by practice of the invention according to the teachings provided in the description. Problem solutions provided by an embodiment of the present invention may be realized and attained by a fixing method, a fixing apparatus, an image formation method, and an image formation apparatus particularly pointed out in the specification in such full, clear, concise, and exact terms as to enable a person having ordinary skill in the art to practice the invention.

To achieve these solutions and in accordance with the purpose of the invention, as embodied and broadly described herein, the invention provides a fixing method, a fixing apparatus, an image formation method, and an image formation apparatus as follows.

[Means for Solving the Problem]

An aspect of the present invention provides a fixing method, comprising steps of:

inserting a recording medium between a pair of belts that are endless;

pressurizing the recording medium only within a nip constituted by a heating roller and a pressurization roller;

conveying the recording medium inserted between the belts by tension of the belts, placing an image on a surface of the recording medium, the surface being stuck to one of the belts, the one being a fixing belt on the side of the heating roller;

maintaining temperature of the recording medium by sandwiching the recording medium between the pair of the belts, where no forced cooling is provided; and controlling a temperature drop to be within a predetermined range, the temperature drop being a difference between a temperature of the fixing belt when the fixing belt is in contact with the heating roller and a temperature of the fixing belt when the recording medium is separated from the fixing belt.

Another aspect of the present invention provides a fixing apparatus, comprising:

a heating roller and a pressurization roller, constituting a nip wherein a recording medium is pressurized;

a first belt that is endless and wound around the heating roller;

a second belt that is endless and wound around the pressurization roller;

wherein the first belt and the second belt constitute a pair and convey the recording medium by belt tension, sandwiching the recording medium;

wherein a surface of the recording medium that carries an image is stuck to the first belt;

wherein the recording medium is kept warm during the conveyance by being sandwiched by the pair of the belts, without compulsorily being cooled; and wherein a temperature drop of the first belt is set to fall within a predetermined range, the temperature drop being a difference of temperatures of the first belt when contacting the heating roller and when separating the recording medium.

Another aspect of the present invention provides a fixing method of fixing a toner image onto a recording medium by heating the recording medium that carries the toner image during conveyance by a pair of belts that are wound around rollers, wherein a guide roller having a small mass is prepared on an inner circumference side of one of the belts, the one touching the toner image, the guide roller is deformed by making sliding contact with the fixing belt, and the recording medium carrying the toner image is sandwiched by the belts and conveyed.

Another aspect of the present invention provides a fixing apparatus wherein a recording medium is sandwiched by a pair of a fixing belt and a pressurization belt at belt tension between 0.001 and 5.4 N/mm for a period between 50 and 1000 ms, and the recording medium that carries a toner image on one side which one side adheres to the fixing belt is conveyed being sandwiched by said belts with the belt tension, comprising:

a pressurizing member for incurvating the recording medium at a conveyance portion where the recording medium is conveyed by the pair of the belts so that the side of the recording medium carrying the toner image becomes an outer circumference with reference to the other side of the recording medium when being discharged after heat is dissipated from the toner image and the toner image is solidified.

Another aspect of the present invention provides a fixing method of fixing a toner image as described with reference to the fixing apparatuses described above.

Another aspect of the present invention provides an image formation apparatus that employs any one of the fixing apparatuses described above.

Another aspect of the present invention provides an image formation method using any one of the fixing apparatuses described above.

[Effect of the Invention]

According to the present invention, heat is fully transferred from the belt to the toner, the recording medium is sandwiched by the belts, and the toner surface is prevented from being exposed to the air; thereby the temperature of the toner is maintained, the toner is sufficiently soft, and the fixing temperature is low compared with the conventional roller fixing.

Further, the embodiment of the present invention realizes allow temperature and energy saving fixing apparatus using a low melting temperature toner, the fixing apparatus being capable of stably separating the recording medium even when printing a color image all over the recording medium. Further, the recording medium is prevented from curling to the image side.

DESCRIPTION OF THE PREFERRED EMBODIMENTS

In the following, Embodiments of the present invention are described with reference to the accompanying drawings.

Embodiment 1

Figure 1:
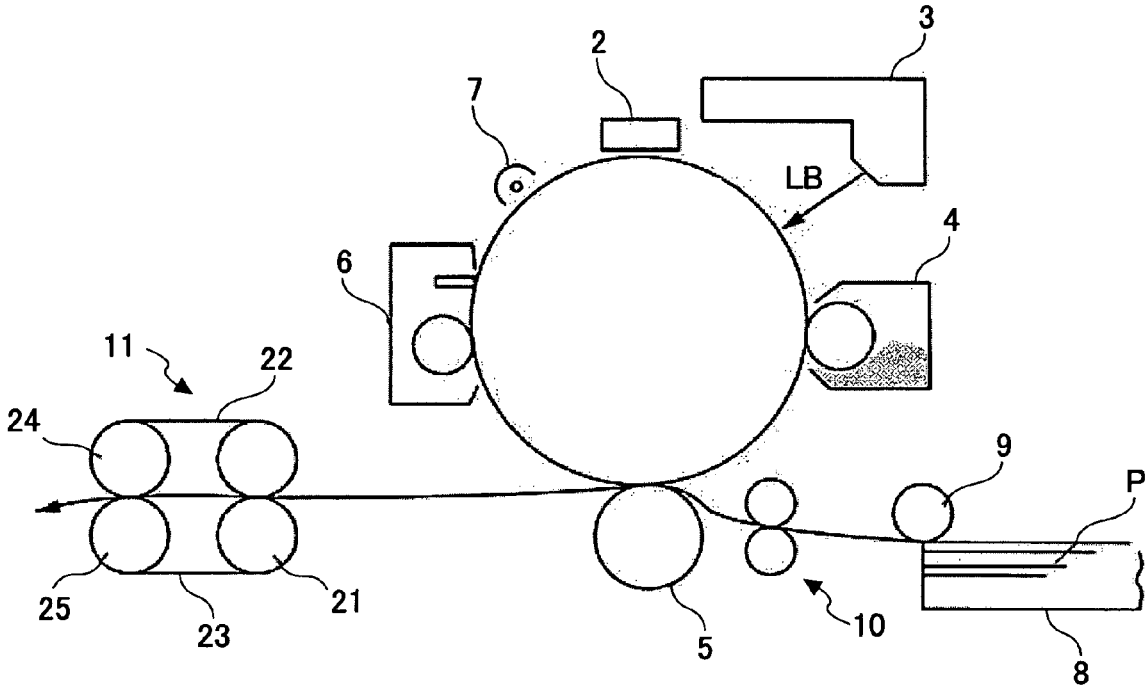
FIG. 1 is a schematic diagram of an image formation apparatus serving as an object to which Embodiments of the present invention are applied.

FIG. 1 is a schematic diagram showing an example of the structure of an image formation apparatus, to which an embodiment of the present invention is applied. The image formation apparatus includes a photo conductor 1 that is shaped like a drum, which supports an image, an electrification apparatus 2 provided near the photo conductor 1 for uniformly charging the surface of the photo conductor 1, an optical writing apparatus 3 for irradiating a writing light LB, such as laser light, onto the electrified photo conductor 1, a development apparatus 4 for developing the electrostatic image on the photo conductor 1 into a toner image by a toner, an imprint apparatus 5 for imprinting the toner image on the photo conductor 1 onto a recording medium P, such as a recording form, a cleaning apparatus 6 for cleaning residual toner, paper power, and the like that remain on the photo conductor 1 after imprinting, and an electric discharger 7 for discharging any residual charge on the photo conductor 1.

Further, the image formation apparatus includes a feed section 8 for feeding the recording medium P to the imprint section between the photo conductor 1 and the imprint apparatus 5, a feed roller 9, a resist roller 10, and a fixing apparatus 11 for thermally fixing the toner image imprinted on the recording medium P. Here, the development apparatus 4 uses a toner, the principal binding component of which is resin.

As shown in FIG. 2, the fixing apparatus 11 includes a heating roller 20, a pressurization roller 21 that is arranged countering the heating roller 20, and pressurizes (presses against) the heating roller 20, drive rollers 24 and 25, and belts 22 and 23 that are wound around the heating roller 20, the drive roller 24, and the drive roller 25, the pressurization roller 21, respectively.

The drive rollers 24 and 25 are for driving the belts 22 and 23, respectively, and serve as tension rollers for obtaining the tension of the belts 22 and 23, respectively. As illustrated, the recording medium P is supplied to the fixing apparatus 11 from the right-hand side of FIG. 2, and is imprinted by the toner T. In addition, the toner T on the recording medium P is constituted by layers; accordingly, the toner T is sometimes called the toner layer T.

Figure 2A:
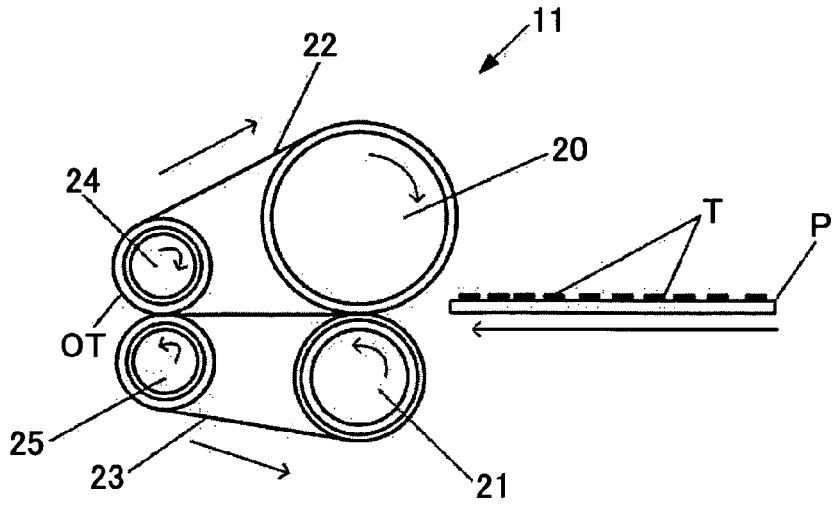
FIGS. 2A, 2B, 2C and 2D are schematic diagrams of a fixing apparatus according to Embodiment 1 of the present invention.
Figure 2B:
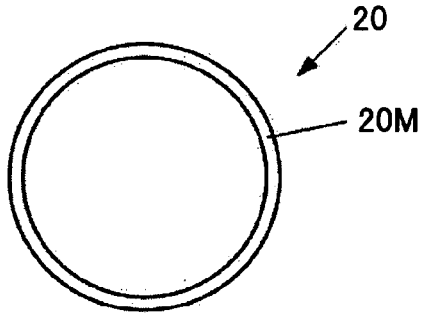
Figure 2C:
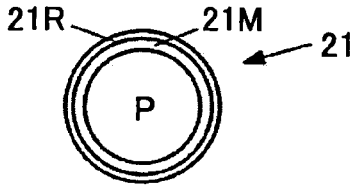

The heating roller 20 is constituted by a hollow metal cylinder (20M in FIG. 2B indicates a metal section forming a hollow metal core), and a halogen lamp (not shown) for heating the metal section 20M. The pressurization roller 21 is constituted by a hollow metal cylinder (a metal section 21M is indicated in FIG. 2C), the surface of which is covered by a rubber layer 21R. The rubber layer 21R is deformed against the metal section 21M so as to obtain appropriate contact with the heating roller 20.

Figure 2D:
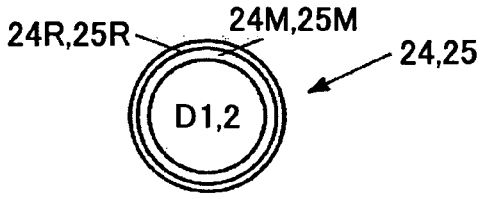

The drive rollers 24 and 25, which serve as tension rollers, are constituted by hollow metal cylinders, the metal sections 24M and 25M of which are indicated in FIG. 2D, the surfaces of which are covered by respective rubber layers 24R and 25R. The rubber generates driving power for the belts 22 and 23 by friction, and provides tension to the belts 22 and 23 upstream.

According to Embodiment 1, whereby the fixing temperature is reduced from the conventional roller fixing, the recording medium P is sandwiched by the pair of the belts 22 and 23 with belt tension between 0.001 and 5.4 N/mm for a period between 50 and 1000 ms, and is strongly pressurized (pressed) only within a nip N constituted by the heating roller 20 and the pressurization roller 21. The pressurization at the nip is between 0.007 and 2.7 N/mm. Then, the recording medium P is conveyed, being sandwiched by the tension of the belts 22 and 23 with the toner image side being stuck to the belt 22. During the conveyance, the recording medium P is not forcedly cooled, but rather, the recording medium P is kept warm between the belts 22 and 23.

Consequently, heat is fully transmitted from the belts 22 and 23 to the toner T on the recording medium P. Further, since the recording medium P is sandwiched by the belts 22 and 23 and the surface of the toner T is not exposed to the external air, the temperature of The toner T is maintained, and the toner T is softened enough compared with the conventional roller fixing method; therefore, the temperature of fixing can be made low.

The reason why the recording medium P is strongly pressurized only while passing the nip of the heating roller 20 and the pressurization roller 21 is as follows.

The toner T on the recording medium P before being fixed comprises particles that constitute a layer, that is, the toner T contains a great amount of air. Accordingly, by pressing the toner T, the air can be removed, which raises thermal conductivity of the toner T. At this time, if the pressure is too low, the air in the toner layer T cannot be completely pushed out; and if, conversely, the pressure is too great, the toner image is crushed, i.e., dot reproducibility is degraded. Accordingly, there is a desired pressure range, which is between 0.01 and 2.2 N/mm, more preferably between 0.05 and 1.8 N/mm, and still more preferably between 0.1 and 1.5 N/mm.

As described above, the recording medium P sandwiched by the belts 22 and 23 is conveyed downstream carrying the toner layer T, from which toner layer T air has been sufficiently removed by the high-pressure nip section N constituted by the heating roller 20 and the pressurization roller 21. Here, the recording medium P is adhered to the belts 22 and 23 by the tension of the belts 22 and 23 that sandwich the recording medium P. Accordingly, heat is efficiently supplied only to the toner T. Further, since the recording medium P is conveyed without being pressurized, heat conduction to the recording medium P is minimized, and energy is not uselessly consumed.

The reason why the belts 22 and 23 are wound around the heating roller 20 and the pressurization roller 21, respectively, with tension is for keeping the recording medium P adhered to the belts 22 and 23. That is, if the tension is too small, the recording medium P easily tends to float from the surface of the belt, which is not desired; and if, conversely, the tension is too great, the belts 22 and 23 tend to be damaged, which is not desirable, either. Accordingly, there is a desirable range for the tension, which is between 0.01 and 5 N/mm, more preferably between 0.05 and 4 N/mm, and still more preferably between 0.1 and 2 N/mm.

Further, in order to provide sufficient heat to the toner T and to keep it warm, the recording medium P is inserted in the nip section N of the heating roller 20 and the pressurization roller 21, and then sandwiched by the belts 22 and 23 for maintaining adhesion for a period between 50 and 1000 ms. If the period is too short, a sufficient amount of heat is not supplied to the toner T and fixing properties become poor. Conversely, if the period is too long, the surface area of the belts 22 and 23 becomes greater, increasing heat dissipation, which is not desirable. Accordingly, there is a desirable range for the period, which range is between 60 and 800 ms, more preferably between 80 and 700 ms, further more preferably between 100 and 500 ms, and still more preferably between 200 and 400 ms.

According to the embodiment of the present invention, energy savings are achieved by providing sufficient heat to the toner T over time, lowering the fixing temperature by raising the fixing nature, thereby reducing the power consumption, reducing heat dissipation by reducing the heat slope with reference to the environment by lowering the fixing temperature, and reducing the temperature rising time by lowering the fixing temperature. Here, if the temperature of the recording medium P, the belts 22, and 23 falls too much during conveyance, the fixing nature will be degraded. Therefore, a device for maintaining the temperature is desired. Inventors hereto have determined that if the temperature drop is no greater than 50° C., a fixing performance equivalent to the conventional roller fixing is obtained. Here, the temperature drop is defined as the difference between the temperature of the fixing belts 22 and 23 when separating the recording medium P (after fixing) and the temperature of the fixing belts 22 and 23 when they are in contact with the heating roller 20. If the temperature drop is greater than 50° C., desired performance may not be obtained. Therefore, the temperature drop is desirably less than 40° C., more preferably less than 30° C., far more preferably less than 20° C., and further more preferably less than 10° C.

As described above, by sandwiching the recording medium P by the belts 22 and 23 with tension between 0.001 and 5.4 N/mm for a period between 50 and 1000 ms, by strongly pressurizing only within the nip section N constituted by the heating roller 20 and the pressurization roller 21 with pressure between 0.007 and 2.7 N/mm, by conveying the recording medium between the belts 22 and 23 by the tension with the image side being adhered to the belt 22, by maintaining the temperature by placing the recording medium P between the belts 22 and 23 (i.e., with no forced cooling) such that the temperature drop is less than 50° C., satisfactory fixing that requires-a lower temperature, less power, and shorter temperature rising time than the conventional roller fixing is realized.

Furthermore, in this configuration, the diameter of the pressurization roller 21 is made smaller than the diameter of the heating roller 20. For example, the diameter of the pressurization roller 21 is between 2 and 95%, more preferably between 5 and 90%, and still more preferably between 10 to 85% of the diameter of the heating roller 20. The diameter of the pressurization roller 21 is desirably between 5 and 150 mm, more preferably between 10 and 130 mm, and still more preferably between 20 and 100 mm.

In addition, in the conventional roller fixing, the diameter of the roller is made great in order to obtain a broad nip section N; in contrast, according to the present invention, since the recording medium P is sandwiched by the belts 22 and 23, the diameter of the pressurization roller 21 does not have to be great. The greater the diameter of a roller is, the greater the mass of the roller is, and the greater is the amount of heat taken out from a heating roller, causing the temperature rising time to become long. Further, if the diameter of the pressurization roller 21 is made greater than the heating roller 20, the rubber layer 21R of the pressurization roller 21 contacts the recording medium P more than necessary at the circumference of the heating roller 20 at the nip section N, which undesirably produces a strong "set" state on the recording medium P, e.g., the recording medium P bending along the circumference of the pressurization roller 21. On the other hand, if the diameter of the pressurization roller 21 is made small, the axis of the diameter of the pressurization roller 21 tends to bend by pressurization, producing undesirable uneven contact with the heating roller 20. Inventors hereto have determined that there is a desirable range for the diameter of the pressurization roller 21 with reference to the heating roller 20, which is between 2 and 95%, more preferably between 5 and 90%, and still more preferably between 10 and 80%. In actual size of the diameter of the pressurization roller 21, the minimum is 5 mm as described above, and the maximum is preferably 150 mm taking the dimensions of the fixing apparatus into consideration. More preferably, the diameter of the pressurization roller 21 is between 10 and 100 mm, more preferably between 20 and 50 mm, still more preferably between 30 and 40 mm.

Further, if the surface of the rubber layer 21R of the pressurization roller 21 is made of a heat resistant rubber layer, the adhesion to the heating roller 20 that is made hard by using metal can be raised. In order to obtain desirable adhesion to the hard heating roller 21, the preferred range of the degree of hardness of the rubber layer 21R of the pressurization roller 21 is between 5 and 80° of JISA, and the preferred range of the thickness is between 0.05 and 30 mm. Further, the rubber layer 21R of the pressurization roller 21 can be covered with a seamless PFA tube such that it serves as a protection layer for the rubber layer 21R that is soft, improving the durability, and preventing the rubber layer 21R from sticking to the belts 22 and 23. In addition, the PFA tube prevents dirt from attaching. Here, the preferred thickness of the PFA tube is between 0.005 and 5 mm.

Further, the hardness degree of the rubber layer 21R is between 10 and 70°, and more preferably, between 20 and 60° if no PFA covering is provided. The preferred hardness degree of the rubber layer 21, if PFA covering is provided, is between 5 and 50°. If the PFA covering is too thick, the concordance of the rubber layer 21R is degraded; and if it is too thin, desired intensity is not obtained. Accordingly, there is a desired range for the thickness of the PFA covering, which is between 0.01 and 3 mm, and more desirably between 0.02 and 1 mm.

In addition, although the axle of the pressurization roller 21 is desired to be tough and flexible, its heat capacity can be lowered by making it of a hollow metal, i.e., reducing the mass of the pressurization roller 21, so that the temperature rising time can be shortened.

As for the belts 22 and 23, if they are too thin, desired strength cannot be obtained; and if they are too thick, the temperature rising time becomes long. Accordingly, there is a desired range for the thickness of the belts 22 and 23, which range is between 30 and 600 μm, more preferably between 40 and 550 μm, still more preferably between 50 and 500 μm, far more preferably between 70 and 450 μm, and further more preferably between 90 and 400 μm.

In addition, the belts 22 and 23 are driven by the drive rollers 24 and 25 working as a pair at a section where the recording medium P is discharged (discharging section) in the conveyance direction. Here, the heating roller 20 and the pressurization roller 21 are driven rollers. In the conventional roller fixing, a heating roller usually serves as a drive roller, and rotates a pressurization roller as a follower. However, according to the present invention, if the heating roller 20 is made to drive, the belt 22 from the nip section N that is the heating part to the outlet section OT tends to lose the tension, which is not desirable. Here, only one of the drive rollers 24 and 25 can be made a drive roller. Of course, both drive rollers 24 and 25 can be made the drive rollers that drive in sync. In this case, it is desired that the peripheral speed difference of the drive rollers 24 and 25 be made less than 5%.

Furthermore, the belts 22 and 23 are firmly driven by forming the rubber layers 24R and 25R on the surface of the drive rollers 24 and 25, respectively, as shown in FIG. 2D. The thickness of the rubber layers 24R and 25R is desired to be between 0.05 and 30 mm. If the rubber layers 24R and 25R are thin, desired durability is not obtained; and if they are thick, deformation tends to take place, causing an uneven driving speed. In order to avoid these problems, there is a desired range of the thickness, which is between 0.1 and 20 mm, and more preferably between 1 and 10 mm.

Further, it is desirable that the axle of the drive rollers 24 and 25 be tough and flexible, and the heat capacity of the drive rollers 25 and 25 can be reduced by making the axles of the drive rollers 24 and 25 with hollow metal.

Some examples of the present Embodiment are described.

EXAMPLE 1

Temperature rising times for different diameters P of the pressurization roller 20 were measured, wherein the core metal of the pressurization roller 20 was 3 mm thick (the core metal being a hollow), and the rubber layer was 1 mm thick. Here, the temperature rising time when the diameter P of the pressurization roller 20 was ϕ50 mm was used as the standard, and set at 1. Results were as shown in the following Table 1.

TABLE 1

| | Diameter of Heating Roller: H | Diameter of Pressurization Roller: P | Temperature Rising Time (normalized) |
|---|---|---|---|
| Case 1 | 50 | 50 | 1 |
| Case 2 | 50 | 40 | 0.8 |
| Case 3 | 50 | 30 | 0.6 |
| Case 4 | 50 | 20 | 0.39 |

As shown in Table 1, the smaller the diameter of the pressurization roller 20 was, the shorter the temperature rising time was.

Example 2

The pressurization roller 20 was made of a solid core metal (i.e., not a hollow) with the diameter being 50 mm. In this case, the normalized temperature rising time was 1.5, verifying that the hollow roller took the shorter temperature rising time than the solid roller.

Example 3

In Case 2 of Table 1 of Example 1 above, a comparison was made between hollow and solid rollers concerning the drive rollers D1 and D2, where the diameter of the drive rollers D1 and D2 was 30 mm and the rubber layer was 1 mm thick. For the hollow roller, the thickness was 3 mm. The temperature rising time of the hollow roller was 0.8, comparing with the temperature rising time of the solid roller that was 0.9. Accordingly, it was verified that the temperature rising time was the shorter with the hollow roller.

Example 4

A solid fixing (printing all over the recording medium) test was performed with Case 3 of Example 1, wherein the belt tension was set at 0.0005 N/mm, and the pressurization was set at 1 N/mm. In this case, uneven fixing by the belt appeared as uneven gloss in the produced image. At this time, the recording medium P was sandwiched by the belts 22 and 23 for 300 ms, and the temperature drop was 10° C.

Example 5

Another solid fixing test was performed with Case 3 of Example 1, wherein the belt tension was set at 0.01 N/mm and the pressurization was set at 1 N/mm. Then, the image was satisfactory without unevenness of fixing. At this time, the temperature drop was 10° C. Further, the fixing temperature in this case was 20° C. lower than fixing by the conventional roller fixing wherein the diameter of the heating roller 20 was 50 mm, and the diameter of the pressurization roller 21 was 30 mm. At this time, the recording medium P was sandwiched by the belts 22 and 23 for 300 ms, and the temperature drop was 10° C.

Example 6

When another solid fixing test was performed with Case 3 of Example 1, wherein the belt tension was set at 0.01 N/mm and the pressurization was set at 0.001 N/mm, the fixing temperature had to be 20° C. higher than required by Example 5. At this time, the recording medium P was sandwiched by the belts 22 and 23 for 300 ms, and the temperature drop was 10° C.

Example 7

A half-tone fixing test was performed with Case 3 of Example 1, wherein the belt tension was set at 0.01 N/mm and the pressurization was set at 5 N/mm, which proved that a dot was fatter by 20% as compared with the case of Example 6. At this time, the recording medium P was sandwiched by the belts 22 and 23 for 300 ms, and the temperature drop was 10° C.

Embodiment 2

Figure 3:
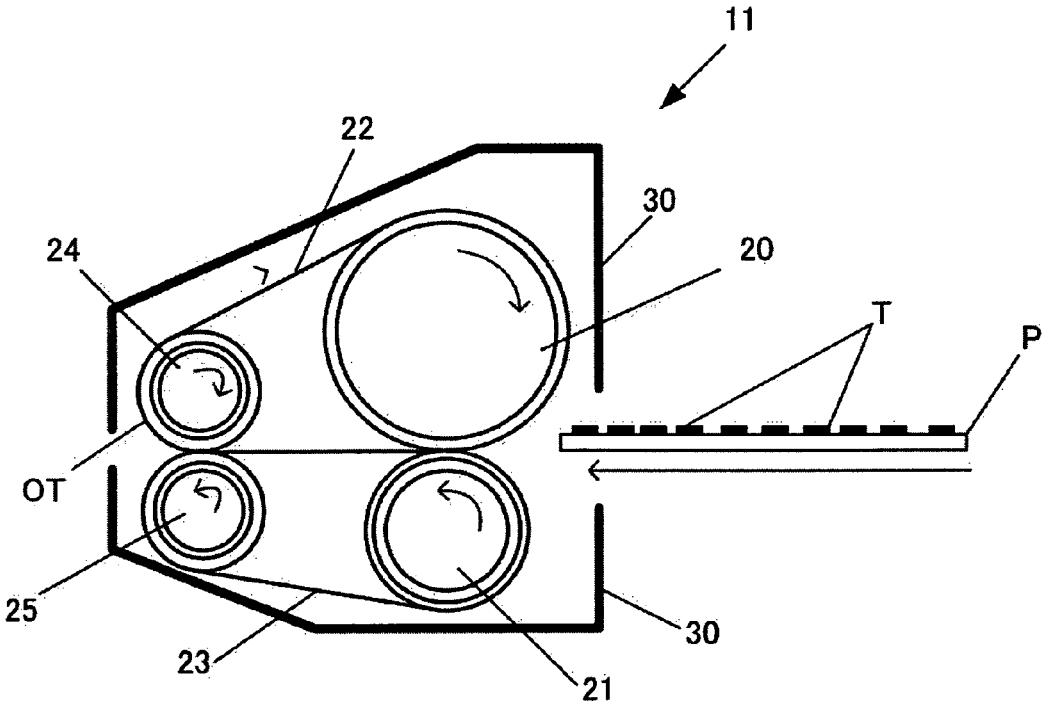
FIG. 3 is a schematic diagram showing the fixing apparatus according to Embodiment 2 of the present invention.

FIG. 3 shows Embodiment 2 of the fixing apparatus according to the present invention. Since the present invention aims at reducing heat dissipation as much as possible, Embodiment 2 includes a device for the purpose, namely, a temperature keeping cover 30, as shown in FIG. 3, for reducing the heat dissipation from the fixing apparatus 11 such that the temperature drop be minimized. The temperature keeping cover 30 helps reduce the power consumption. In the case that the temperature keeping cover 30 was made of an adiathermanous material, the power consumption was reduced by about 10%.

Embodiment 3

Figure 4:
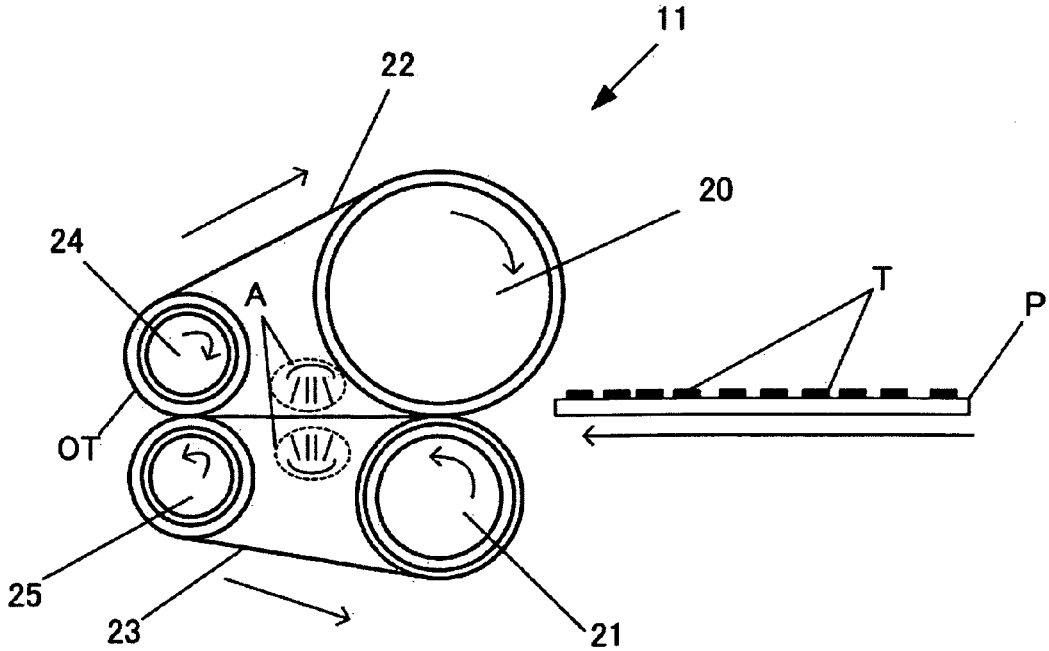
FIG. 4 is a schematic diagram showing the fixing apparatus according to Embodiment 3 of the present invention.

FIG. 4 shows the fixing apparatus according to Embodiment 3 of the present invention, wherein air A is blown onto the belts 22 and 23.

A fixing test was performed with Case 3 of Example 1 of Embodiment 1 (refer to Table 1) with the belts 22 and 23 being cooled by the air A. In this case, the fixing temperature had to be raised by 20° C. to obtain satisfactory fixing. Here, the recording medium P was sandwiched by the belts 22 and 23 for 300 ms, and the temperature drop from the fixing temperature to the temperature at the outlet section (discharging section) OT was 55° C.

Embodiment 4

Figure 5:
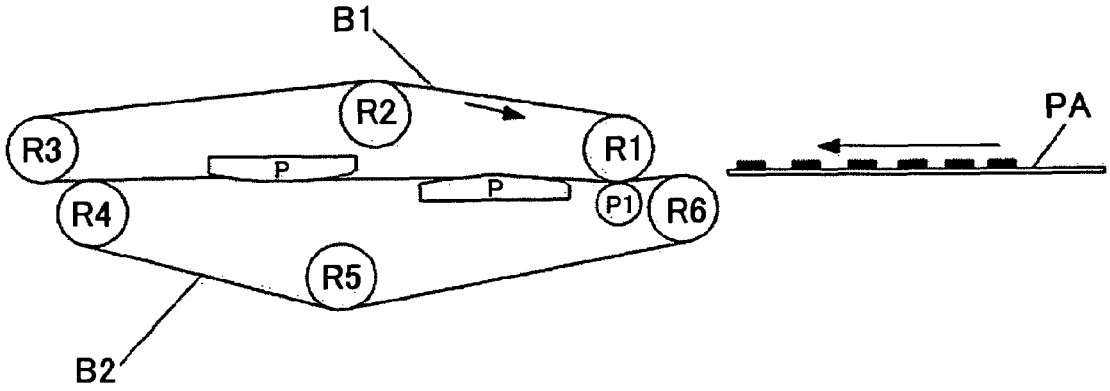
FIG. 5 is a schematic diagram showing the fixing apparatus according to Embodiment 4 of the present invention.

FIG. 5 shows the fixing apparatus according to Embodiment 4 of the present invention. The fixing apparatus includes a heating roller R1, drive rollers R3 and R4, tension rollers R2 and R5, an auxiliary roller R6, a pressurization roller P1, auxiliary guide boards P, and a recording medium PA. The pressurization roller P1, countering the heating roller R1, is made to contact the heating roller R1 with pressure. Belts B1 and B2 are supported by the heating roller R1 and the pressurization roller P1, respectively, and driven by the drive rollers R3 and R4, respectively. Here, the drive rollers R3 and R4 may serve as tension rollers for stretching the belts B1 and B2.

The belts B1 and B2, where they are in close contact, tend to undesirably vibrate while in conveyance. Inventors hereto have determined that the undesired vibration can be prevented from occurring by providing the auxiliary guide boards P to the rear side of each of the belts B1 and B2, the rear side being the side opposite to the side that are in close contact to the other belt, such that the auxiliary guide boards P pressurize the corresponding belts B1 and B2.

The auxiliary guide boards P are fixed guide plates, and are arranged such that they bite (i.e., press up or down, as applicable) the belts B1 and B2 by a certain magnitude with reference to where there are no auxiliary guide boards P. If the magnitude to too small, the undesired vibration cannot be suppressed; and if the magnitude is too great, friction undesirably becomes too great. Accordingly, there is a preferred range as for the magnitude, which is between 0.01 to 10 mm, more preferably between 0.1 and 5 mm, and still more preferably between 0.2 and 2 mm.

Further, the surface of the auxiliary guide boards P is preferably a sculptured surface, radius of curvature of which is preferably between 200 and 100000 mm as converted to a true circle, more preferably between 300 and 50000 mm, and still more preferably between 500 and 10000 mm. By shaping the surface of the auxiliary guide boards P as described above, unevenness of the contact surface of the belts B1 and B2 is absorbed.

Figure 6:
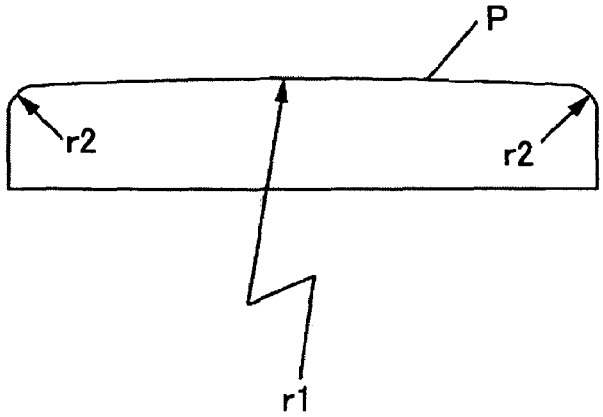
FIG. 6 is a schematic diagram showing an auxiliary guide board used in Embodiment 4 show in FIG. 5.

Further, since the auxiliary guide boards P are arranged such that they bite the respective belts B1 and B2, the point of osculation, i.e., where the end of the auxiliary guide boards P and the belts B1 and B2 meet, should be shaped such that a smooth contact is obtained. In order to absorb the frictional force produced by the belts B1 and B2 at the end of the auxiliary guide boards P, the shape of the auxiliary guide boards P is made as shown in FIG. 6. Specifically, both ends touching the respective belts of the auxiliary guide boards P have a radius of curvature r2 that is smaller than the radius of curvature r1 of the main section of the surface such that the belts B1 and B2 smoothly meet the respective auxiliary guide boards P from a middle point of the curved surface of the main section.

While the undesired vibration of the belts B1 and B2 is prevented from occurring as described above, the auxiliary guide boards P tend to dissipate heat, which is against the objective of the present invention that aims at energy savings. In order to prevent dissipation of the heat from the auxiliary guide boards P, according to the present invention, a heat insulation layer is prepared on the surface of the auxiliary guide boards P. As the heat insulation layer, materials that have an air layer in the interior, such as porous ceramics and porous felt, are desirable. Inventors hereto have found that the heat insulation layer satisfactorily maintains the temperature. Although, it is ideal that the belts B1 and B2 sandwiching the recording medium PA be floated in the air while fixing is carried out, being isolated from the outside as much as possible, the reality is that suitable support members and auxiliary members are needed. Accordingly, the present embodiment solves this problem as described above.

Further, the smaller the mass of the auxiliary guide board P is, the shorter the standup time of the fixing apparatus is, and the quicker the temperature of the auxiliary guide board P saturates. The mass of the auxiliary guide board P is desirably less than 500 g, more preferably less than 400 g, more preferably less than 300 g, more preferably less than 200 g, and still more preferably less than 100 g. Further, in order to enhance the performance of the auxiliary guide boards P, a heat insulator can be used at a part where the auxiliary guide boards P are affixed; then further quicker temperature saturation can be obtained. As for sequence of the auxiliary guide boards P contacting the belts B1 and B2, a higher effect is obtained if the first contact is on a side that is opposite to the fixing side that carries the toner image. This is to keep the heat on the fixing side as long as possible. Further, more than two auxiliary guide boards P can be provided, alternately upper and lower sides, which may be preferred in the case where the belts B1 and B2 sandwich the recording medium PA for a longer distance.

Further, a protection layer of low friction may be provided to the surface of the auxiliary guide board P such that the durability of the auxiliary guide board P is enhanced, service life of the auxiliary guide board P and the belts B1 and B2 is prolonged, and a lower belt driving torque is required. Further, by adjusting surface granularity of the protection layer, the belts B1 and B2 are prevented from hermetically sticking to the corresponding auxiliary guide boards P by atmospheric pressure.

As the protection layer having low friction, although resin of such as Teflon (registered trademark) system and a silicon system can be considered, other low friction material may be used. As for the surface granularity, a desired range of Rz is between 0.01 and 200 μm, given that if the granularity is too low, friction becomes great by adhesion; and if too coarse, thermal conductivity will fall.

EXPERIMENTAL EXAMPLE 1

A fixing operation was conducted with the structure shown in FIG. 5. No vibration of the belts B1 and B2 was observed, and a satisfactory image was obtained. When the auxiliary guide boards P were removed, the belts B1 and B2 undesirably vibrated, and a produced image had unevenness.

Experimental Example 2

(Condition 1)

A fixing test was conducted with the structure shown in FIG. 5 with the amount of bite of the auxiliary guide boards P to the corresponding belts B1 and B2 being 20 mm. Then, wear of the auxiliary guide boards P and the belts B1 and B2 was observed after processing 10000 sheets, and fine vibration of the whole mechanism of the fixing apparatus was observed due to the torque being great. Here, the radius of curvature r1 of the surface of the auxiliary guide board P was 1000 mm, and the device of making the radius of curvature r2 on the top ends was not used.

(Condition 2)

Next, the radius of curvature r2 was made to the top ends of the surface of the auxiliary guide boards P, r2 being equal to 50 mm. Then, wear of the auxiliary guide boards P and the belts B1 and B2 and was within a tolerable level after processing about 20000 sheets. However, after processing 30000 sheets, wear was considerably observed. Although the fine vibration was not observed, the rubbing sound was still observed, which was determined to be undesirable.

(Condition 3)

Then, the amount of bite was set to 5 mm. In this case, wear was within a tolerable level after processing 100000 sheets, and a little wear was observed after processing 200000 sheets. No rubbing sound was observed. Thus, considerable improvements were obtained.

EXPERIMENTAL EXAMPLE 3

Further to Condition 3 of Example 2, the surface of the auxiliary guide board P was sandblasted to Rz=2 μm. Then, wear was not a concern after processing 500000 sheets, although a little but acceptable wear was observed at 700000 sheets.

Experimental Example 4

Further to Conditions 3 of Embodiment 2, a silicon resin layer was prepared on the surface of the auxiliary guide board P. Then, wear was not a concern after processing 600000 sheets, although a little but practically acceptable wear was observed at 800000 sheets.

Experimental Example 5

The temperature rising time in the case where the auxiliary guide board P was made of aluminum was 30 seconds, which was shortened to 20 seconds (reduction by 10 seconds) when porous ceramics 5 mm thick were formed on the surface of the auxiliary guide board P.

As described above, it is generally difficult for the belts B1 and B2 to stably sandwich the recording medium PA without vibration, i.e., without the belts B1 and B2 floating (departing) from the recording medium PA. Embodiment 4 solves this problem by providing the auxiliary guide boards P, thereby undesired vibration is suppressed, and a satisfactory image is produced. Further, shortening the temperature rising time is realized by providing the heat insulation of the auxiliary guide boards P. Further, according to Embodiment 4, reduction of the power consumption of the fixing apparatus is realized by reducing the power consumption during the fixing operation, and by stopping power supply during standby of the fixing apparatus, still obtaining a satisfactory quality image.

Embodiment 5

Figure 7:
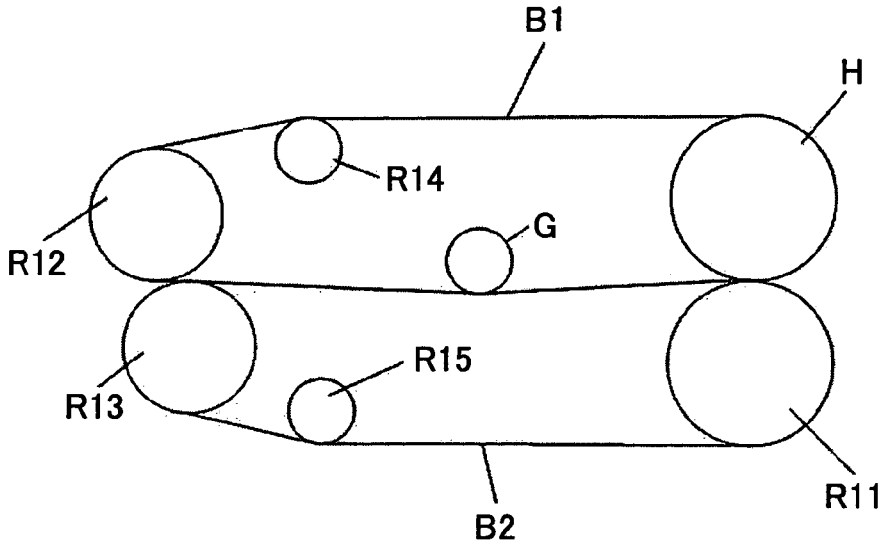
FIG. 7 is a schematic diagram showing the fixing apparatus according to Embodiment 5 of the present invention.

Embodiment 5 solves the problem of the belts B1 and B2 wearing by friction of the auxiliary guide boards P. Specifically, the fixing apparatus according to Embodiment 5 includes one or more guide rollers G as shown in FIG. 7. The guide roller G shortens unsupported sections of the belts B1 and B2 such that stable conveyance of an image adhered to the fixing belt is obtained. Further, in order to minimize a difference between moving distances of the belts B1 and B2 due to conveyance direction change, the amount of the guide roller G biting the belt B1 is set at within 20 mm, the belt B1 being wound around a fixing roller H and the drive roller R12. Since the guide roller G is a follower roller, wear of the surfaces of the guide roller G and the belts B1 and B2 due to friction is minimized. The fixing apparatus further includes the pressurization roller R11, the drive roller R13 for driving the belt B2, and tension rollers R14 and R15 as shown in FIG. 7.

By the way, so long as the conveyance direction of the belts, B1 and B2 is linear between a pair of rollers, there is no problem. In the case where speeds of the belts B1 and B2 are regulated by peripheral speeds of the corresponding drive rollers, if the conveyance direction changes, the moving (displacement) lengths of the belts B1 and B2 on the guide roller become different.

Figure 8:
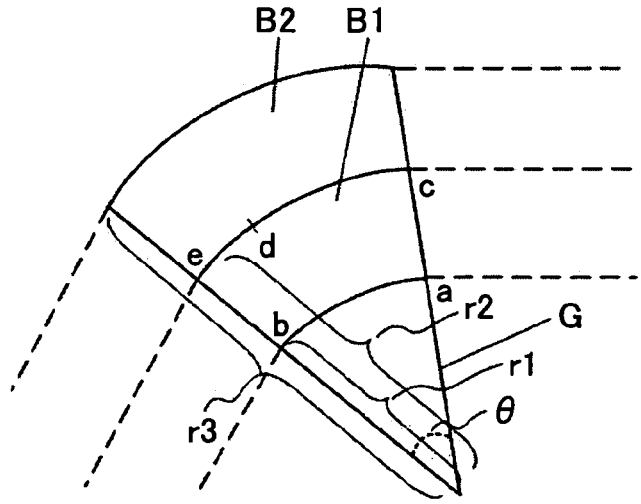
FIG. 8 is a schematic drawing explaining a belt displacement when conveying a pair of belts sandwiched between a pair of rollers.

Specifically, with reference to FIG. 8, when the lower belt 22 moves along the guide roller G having a radius r1, the undersurface of the lower belt 22 moves a distance between a and b (ab), the distance being equal to θ×R1, which is further equal to a distance between c and d (cd). Here, since the belt 22 is not a rigid body but has elasticity, the upper surface is stretched, and moves a distance between c and e (ce). At this time, since the upper belt 23 moves at a speed regulated by the corresponding drive roller, the undersurface of the belt 23 moves the distance between c and d (cd), which is equal to the distance between a and b (ab); that is, behind the belt 22 by a distance equivalent to ed=ce−cd. Since the recording medium P is in fact sandwiched by the belts 22 and 23, and a slip is generated between the belt 22 and the recording medium P, the shift (difference in moving distances) as described above does not occur. However, this is not a desirable state. Accordingly, the present Embodiment regulates the amount of bite of the guide roller G to avoid this problem.

A rate of the shift is defined by the following formula.

$$\begin{aligned}\text{Rate (\%) of the shift} &= (ed/ab)\times 100\\ &= \{(ce-ab)/ab\}\times 100\\ &= (r2-r1)/r1\times 100\end{aligned}$$

where ed=θ(r2−r1) and ab=θ(r1)

Since (r2−r1) is equal to the thickness of the belt 22, and is a small constant value; the greater the r1 is, the smaller the rate of the shift becomes.

Figure 9:
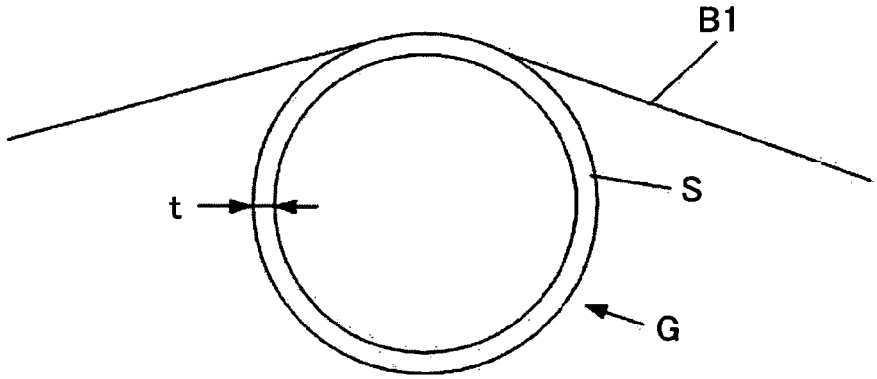
FIG. 9 is a schematic diagram showing a modification of Embodiment 5 shown in FIG. 7.

Although a certain level of energy saving is attained by lowering the fixing temperature according to the configuration as described above, it is possible to raise completeness as the energy saving fixing method and fixing apparatus by adding a further device. Specifically, in order to reduce heat dissipation from the belts B1 and B2, surfaces of the rollers that suspend the belts are covered by a heat insulation layer S as shown in FIG. 9, the rollers including the drive rollers R12 and R13, the tension rollers R14 and R15, the guide roller(s) G, and the pressurization roller R11. The heat insulation layer S is made of a material that has thermal conductivity below 0.15 W/m/k in the thickness of 0.2 mm or greater. For example, the thermal conductivity values of aluminum and steel of such as the guide roller G are about 240 W/m/k and about 80 W/m/k, respectively, that is, the amount of heat dissipation is great. Accordingly, the metal rollers are covered by a material having a poor thermal conductivity, such as rubber of 0.15-0.20 W/m/k, in order to reduce heat dissipation. Here, as the heat insulator, the material is not limited to rubber, but other materials can be used such as porous objects such as sponge, ceramics, and a material with a vacuous space.

It is desirable that the heat conductivity of the material be 0.15 W/m/k or less, and more preferably 0.10 W/m/k or less. Further, it is desirable that the thickness of the heat insulation layer S be 0.2 mm or greater from viewpoint of durability of the material, more preferably 1 mm or greater, further more preferably 2 mm or greater, and further more preferably 5 mm or greater. However, if the thickness of the heat insulator is too great, the fixing apparatus itself becomes too large; accordingly, 50 mm or less is usually considered to be preferred.

Further, the smaller the mass of the heating roller H is, the higher the temperature rising speed is. Therefore, if the mass of the heating roller H is made small, it can be quickly heated, and therefore, it does not have to be kept warm during standby; accordingly, energy saving can be attained. However, if the mass of the heating roller H is made too small, mechanical strength of the heating roller H falls too much, which poses a problem. Accordingly, there is a range for the desirable mass per unit length of the heating roller H, which range is between 0.177 and 17.7 g/cm, more preferably, between 0.5 and 15 g/cm, and further more preferably between 1 and 10 g/cm.

In addition, if a heat insulation bushing is provided to the heating roller H and the guide roller G that receive the heat generated by the fixing apparatus, the heat is prevented from transferring (dissipating). Further, although the mass of the guide roller G is required to be small, when the mass tends to become great for any reason, e.g., due to arrangement or due to requirements concerning the radius of curvature of the guide roller G, the mass can be decreased by making the guide roller G hollow. Further, since it is necessary to shorten return time in order to decrease the standby power, the thermal conductivity of the heating roller H is required to be as great as possible. For this reason, the heating roller H is desired to be made of metal, preferably aluminum, an aluminum alloy, copper, and a copper alloy.

Further, the metal core of the guide roller G is preferably made of steel or a steel alloy. In addition, a coefficient of friction of the surface of the guide roller, G needs to be great such that the guide roller G rotates with movement of the belt B1. The coefficient of friction should be 0.09 or greater in terms of static friction tangent as measured by a Heidon coefficient-of-friction measuring device. See http://www.heidon.co.jp/home.htm. If the static coefficient of friction is lower than described above, the belt B1 will slip, causing wear.

Experimental Example 6

With the structure of FIG. 7, a fixing test was performed under the following conditions, namely, the diameter of the guide roller=40 mm, the amount of guide-roller intrusion (biting)=5 mm, the surface distance between the heating roller and the guide roller in the direction of the axis=10 mm, the surface distance between the drive roller and the guide roller in the direction of the axis=10 mm, the mass of the guide roller=200 g, and the thickness of the belt=150 μm. Then, a high quality image with no blur was obtained.

COMPARATIVE EXPERIMENTAL EXAMPLE

Another fixing test was conducted under the same conditions as described above in Experimental Example 6, except that the guide roller intrusion was set at 60 mm. Then, the image was blurred.

Experimental Example 7

The guide roller, the drive roller, the tension roller, and the pressurization roller having diameters r of 5 mm, 10 mm, 5 mm, and 15 mm, respectively, and having corresponding heat insulators S, the thickness t of which were 2 mm, 1 mm, 2 mm, and 5 mm, respectively, were prepared and applied to the structure of FIG. 7. As a result, the time required to be ready for fixing was shortened by 20 seconds as compared with the case where there are no heat insulators.

Embodiment 6

Figure 10:
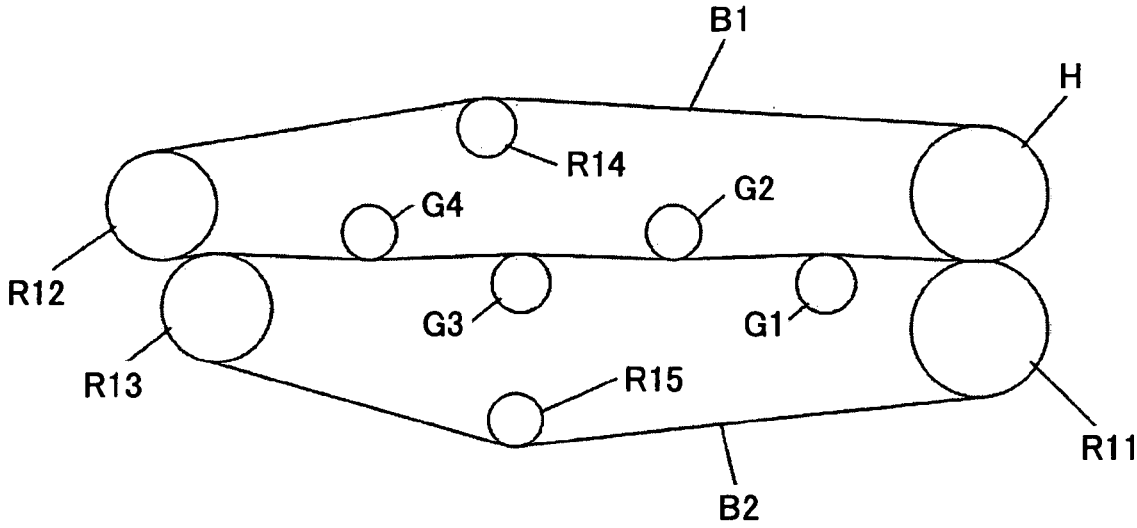
FIG. 10 is a schematic diagram showing the fixing apparatus according to Embodiment 6 of the present invention.

Further, two or more guide rollers may be arranged on the slide contacting side of the inner circumference of the belts B1 and B2. Although blur of image is hardly generated by the structure of Embodiment 5, if guide rollers G1 through G4 are alternately arranged as shown in FIG. 10, minute adjustment is automatically carried out such that alternate blurs are compensated for. In this way, image blur can be further minimized, i.e., nearly completely removed.

According to experiments carried out by Inventors hereto, it was desired that the amount of deformation of the guide roller, i.e., the intrusion to the guide roller of the belt, be small. However, if intrusion becomes negative, no effect is obtained and it is meaningless. If the intrusion is zero, i.e., just touching, vibration of the belt in the negative direction is prevented from occurring. As a result of further studies, it was determined that if the amount of intrusion is 20 mm or less, the influence to image blur was minimized. Preferred ranges of the intrusion were between 0.01 and 18 mm, more preferably between 0.05 and 12 mm, still more preferably between 0.1 and 8 mm, and further more preferably between 0.2 and 5 mm. Further, with the structure of this Embodiment, while it is preferable that the distance between guide rollers be small, the small distance requires a greater number of the guide rollers. Accordingly, there is a preferred range of the distance, which is between 1 and 200 mm, more preferably between 5 and 100 mm, and still more preferably between 10 and 50 mm.

Experimental Example 8

With the structure of FIG. 10, the guide roller, the drive roller, the tension roller, and the pressurization roller having diameters r of 5 mm, 10 mm, 5 mm, and 15 mm, respectively, and having corresponding heat insulators S, the thickness t of which were 2 mm, 1 mm, 2 mm, and 5 mm, respectively, were prepared and applied to the structure of FIG. 10. As a result, the time required to be ready for fixing was shortened by 30 seconds as compared with where there were no heat insulators. Further, a high quality image with no image blur was obtained.

Experimental Example 9

A heat insulation bushing was put into the bearing section of the heating roller H. Then, time until fixing became ready was shortened by 10 seconds in comparison with where the heat insulation bushing was not employed.

Embodiment 7

Figure 11:
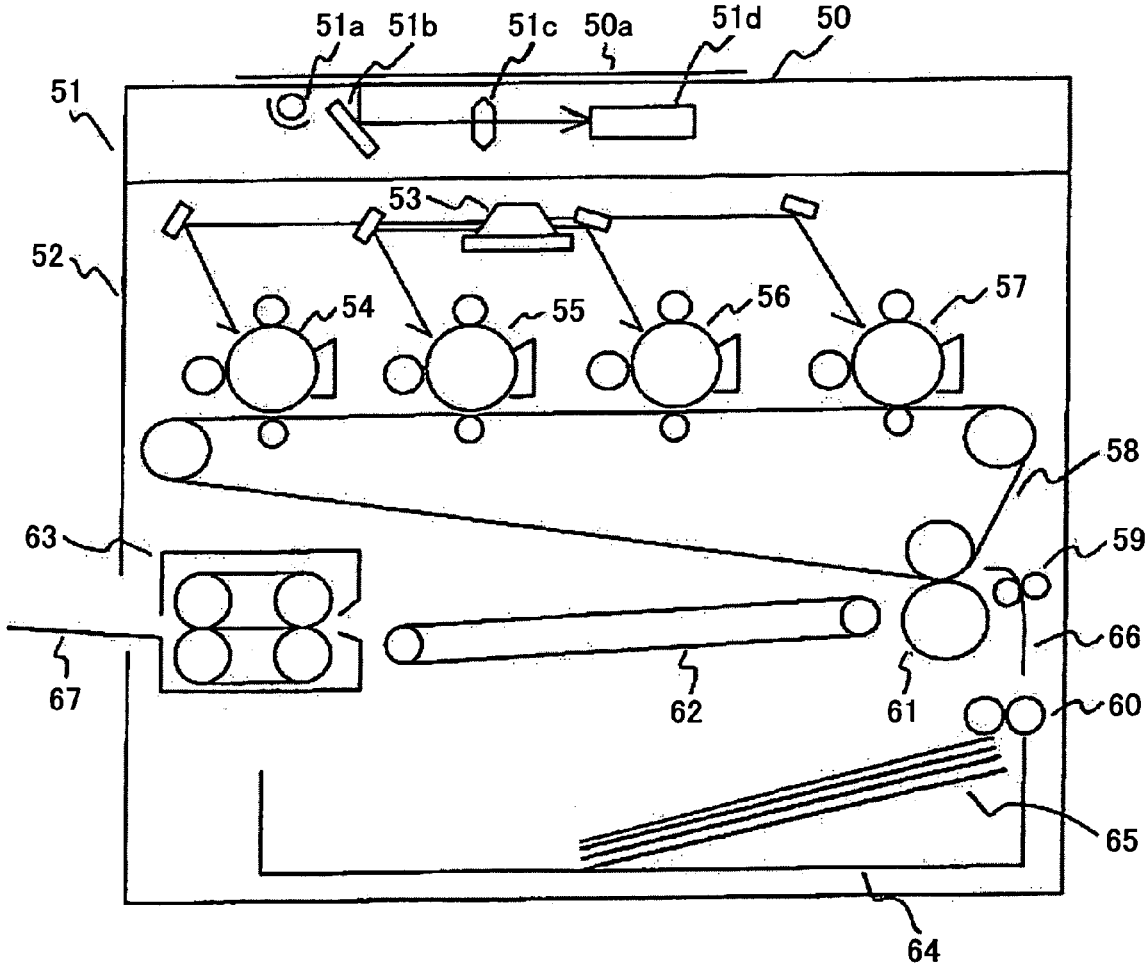
FIG. 11 is a schematic diagram showing the outline of an image formation apparatus according to Embodiment 7 of the present invention.

Next, Embodiment 7 of the present invention is described in detail. FIG. 11 is a schematic diagram showing the outline of an image formation apparatus 50 according to Embodiment 7. When the image formation apparatus 50 is a copying machine, a reading section 51 reads a manuscript, and converts it into digital data serving as a writing signal. When the image formation apparatus 50 is a printer, an image signal from a computer is converted into a writing signal. The writing signal is constituted by signals for cyan, yellow, magenta, and black colors, and optical writing is performed to photo conductor units 54 through 57 for corresponding colors by a polygon mirror 53. On each of the photo conductor units 54 through 57, a toner image is formed for the corresponding color by a process of electrification, writing, and development. The toner images are piled up (superposed) on a middle imprint belt 58, and imprinted on recording paper by a secondary imprint roller 61. The top sheet of recording paper 65 is taken out from a tray 64 by a pickup roller 60, and transported to a resist roller 59 through a feed path 66. Then, the toner image on a conveyance belt 62 is imprinted onto the recording paper taking proper timing. The recording paper on which the toner image is imprinted is conveyed to a fixing apparatus 63 by a conveyance belt 62. After heating and fixing the toner, the recording paper is discharged through a delivery unit 67. In addition, the image formation apparatus 50 includes a contact glass 50*a* on the top; the reading section 51 located at the bottom includes a luminous source 51*a*, a mirror 51*b*, a lens 51*c*, and an image formation element 51*d*.

Figure 12:
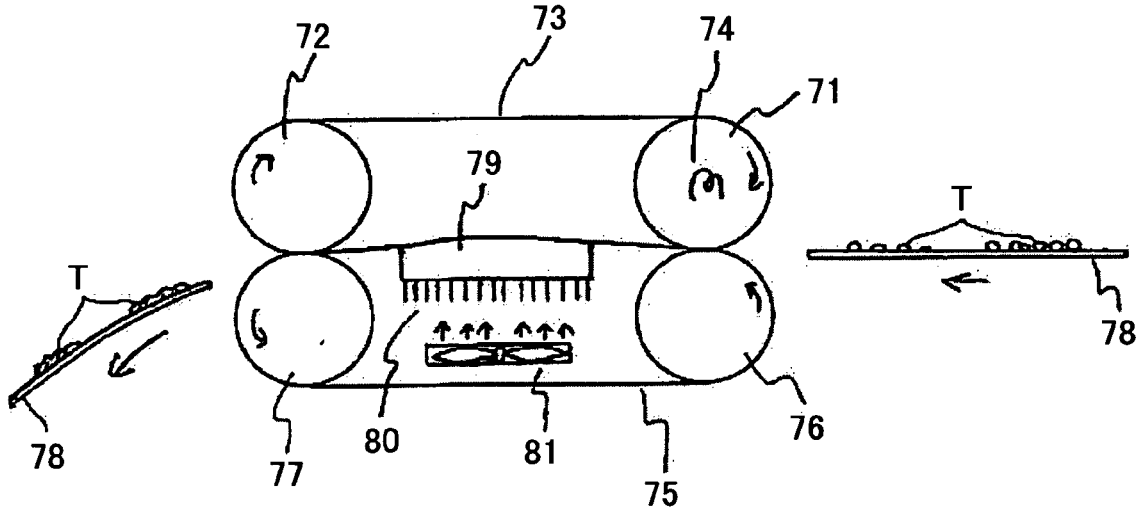
FIG. 12 is a schematic diagram of the fixing apparatus according to Embodiment 7.

FIG. 12 is a schematic diagram of the fixing apparatus of Embodiment 7. An endless fixing belt 73 is hung between a heating roller 71 and an upper tension roller 72. A heater 74 is installed in the heating roller 71 for heating the fixing belt 73 at a predetermined temperature. A pressurization belt 75 is hung between lower tension rollers 76 and 77, the pressurization belt 75 contacting and being driven by the fixing belt 73. Recording paper 78 is conveyed such that it is inserted between the fixing belt 73 and the pressurization belt 75, and is further conveyed. A heat sink 79 having a curved form pressurizes the backside of the pressurization belt 75 such that a tension of 1 N/mm is given to the fixing belt 73 and the pressurization belt 75. The heat sink 79 has a heat dissipation fin 80 that is cooled by ventilation by an air cooling fan 81. Heat is exchanged with the open air such that heat dissipation of the toner on the recording paper 78 is accelerated during conveyance for solidification of the toner. That is, the toner image is properly cooled and solidified by accelerating the heat exchange by the heat sink 79 with the open air by cooling the heat dissipation fin 80 by the air cooling fan 81 while the recording paper 78 is conveyed along the curved form.

That is, in this example, the recording paper 78 is conveyed along the curved form between the endless fixing belt 73 and the pressurization belt 75, the toner image on the surface of the recording paper 78 is heated and cooled, the recording paper 78 being adhered to the fixing belt 73, and then, the toner side is separated from the fixing belt 73. In this way, the toner image is already solidified when separating from the fixing belt 73. Accordingly, toner that is fused at about 100° C. can be used without fear of the toner offsetting onto the fixing belt 73 due to low viscosity. That is, low temperature fixing is realized, and a desired energy-saving fixing system is obtained. In the system described above, it is necessary to apply a predetermined magnitude of tension to the pair of the belts 73 and 75 for maintaining the adhesion state of the recording paper 78 on the belts 73 and 75 as described above. If the tension is too small, the recording paper tends to float, which is not desirable. If the tension is too great, the belts 73 and 75 may be extended or become easy to fracture, which is not desirable. Accordingly, there is a preferred range of the tension, which is between 0.01 and 5 N/mm, more preferably between 0.05 and 4 N/mm, and further more preferably between 0.1 and 2 N/mm.

Further, according to this example, the recording paper 78 sandwiched by the belts 73 and 75 is maintained in an adhesion state between the belt 73 and 75 for a period between 50 and 1000 ms after passing the nip constituted by the heating roller 71 and the lower tension roller 76 serving as a pressurization roller. In this way, heat sufficiently gets across to the toner and the toner is kept warm. That is, if the period is too short, the toner does not receive enough heat, and the fixing performance is degraded. Conversely, if the period is set too long, the superficial area of the belt increases, which increases heat dissipation, which is not desirable. Accordingly, there is a desirable range for the period, which is between 60 and 800 ms, preferably between 80 and 700 ms, more preferably between 100 and 500 ms, and further more preferably between 200 and 400 ms.

Figure 13:
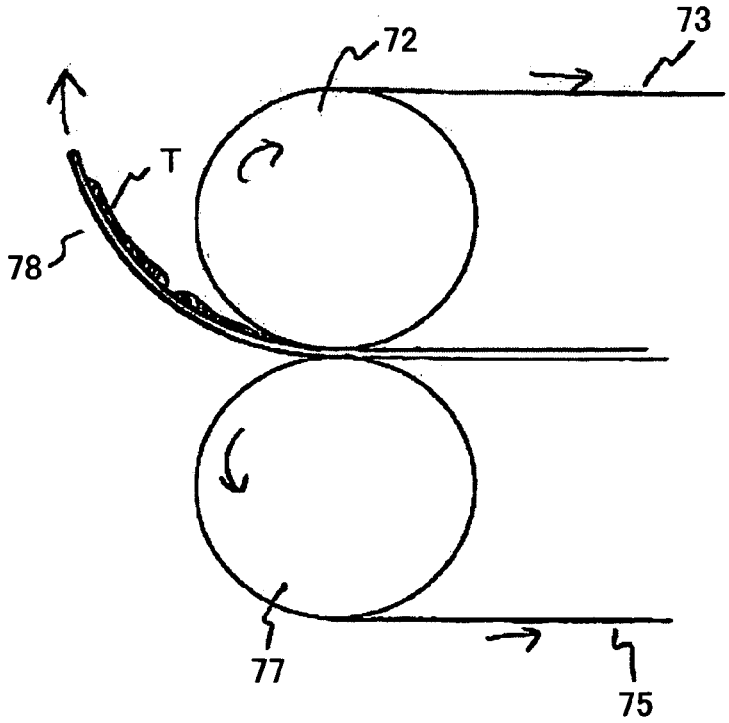
FIG. 13 is a schematic diagram explaining curl in a discharge section of the fixing apparatus.
Figure 14:
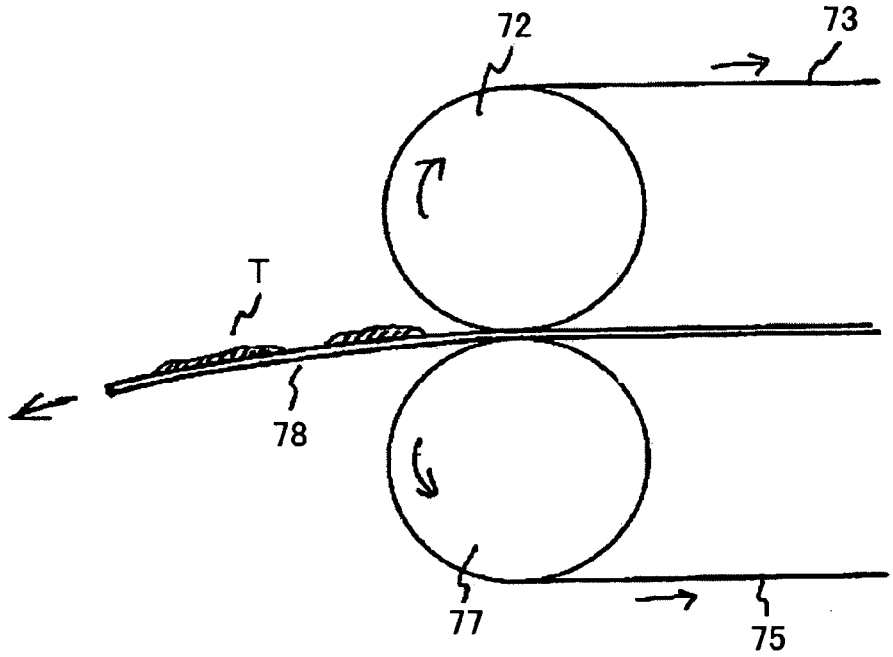
FIG. 14 is a schematic diagram of the fixing apparatus according to the present invention when discharging a recording medium.

As described above, according to this example, the recording paper 78 is made to curve between the belts 73 and 75 with the toner image side of the recording paper 78 being on the convex side. Usually, without the curvature, the recording paper tends to curl as shown in FIG. 13, because grains of the toner on the surface of the recording paper 78 are fused and bonded to each other. The greater the size of the recording paper 78 is, the greater the curling tendency is. In this connection, by cooling and solidifying the toner image by incurvating the recording paper 78 in the reverse curling direction as shown in FIG. 12, the curling to the side of the fixing belt 73 when discharging the recording paper 78, which is otherwise a problem, is solved as shown in FIG. 14. Further, since the recording paper 78 naturally separates from the fixing belt 73, separation nails are dispensed with. For this reason, a scratch due to the separation nails is not a concern, further enabling obtaining a high quality color print.

As described above with reference to FIG. 12, the structure is such that the belts 73 and 75 are pressurized by the heat sink 79 from the side of the pressurization belt 75. Therein, the recording paper 78 is conveyed along the curvature of the heat sink 79, being sandwiched by the belts. In this way, floating and vibrating of the recording paper 78 are prevented from occurring. This contributes to the natural separation of the recording paper 78 from the fixing belt 73 as shown in FIG. 14.

Since the heat sink 79 serves as the pressurizing member and performs heat exchange with the open air, the recording paper 78 is conveyed, being adhered to the belts, along the curved form of the heat sink 79, while the toner image is cooled and solidified. This contributes to the natural separation of the recording paper 78 from the fixing belt 73, and preventing the curl to the side of the fixing belt 73 when discharging the recording paper 78, dispensing with a separation nail.

Experimental Example 10

Figure 17:
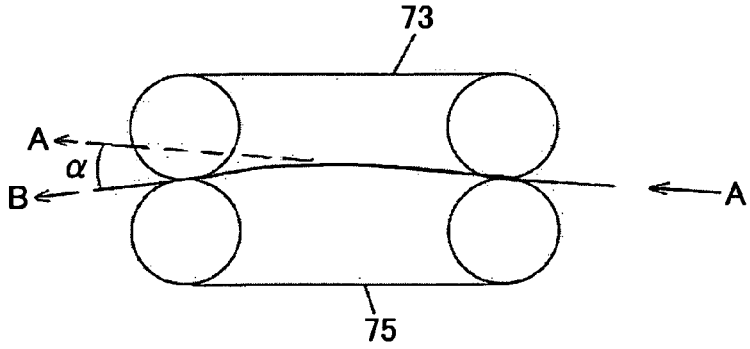
FIG. 17 is a schematic diagram explaining a curve of a belt of the fixing apparatus according to an embodiment of the present invention.

A fixing test was conducted under conditions of control temperature of the heating roller 71=125° C., conveyance speed of the recording paper 78=300 mm/s (the time while the recording paper 78 is sandwiched for 300 ms), nip width constituted by the belts 73 and 75=90 mm, pressure exerted on the pressurization belt 75 by the heat sink 79=0 (i.e., an angle α between the entrance passage and the discharge passage as shown in FIG. 17 is 0). When the recording paper 78 has a great image area like a color photography print, the recording paper 78 was delivered being curled as shown in FIG. 13, and was loosely wound around the fixing belt 73 side. Then, the heat sink 79 was arranged to provide pressure such that the angle α was 10°; at this time, the recording paper 78 having the same size was naturally (without a separation nail) discharged almost linearly (horizontally).as shown in FIG. 14, providing a high quality color print without a scratch of a separation nail.

Here, the composition of the toner that was used is as follows.

| | |
|---|---|
| Cyclic isoprene | 30 wt % |
| Polyester | 60 wt % |
| Carnauba wax | 10 wt % |
| Carbon black | 10 weight parts |
| Electric-charge control agent of negative electrification nature | 1 weight part. |

The softening point of the toner was 80° C., and the lowest fixing temperature was 85° C. Further, the fixing belt 73 was made of a 50 μm thick poly imide film that was electric conduction processed with its surface being made of a 30 μm thick PFA tube, and the pressurization belt 75 was made of a 80μm thick insulating poly imide film.

Embodiment 8

Figure 15:
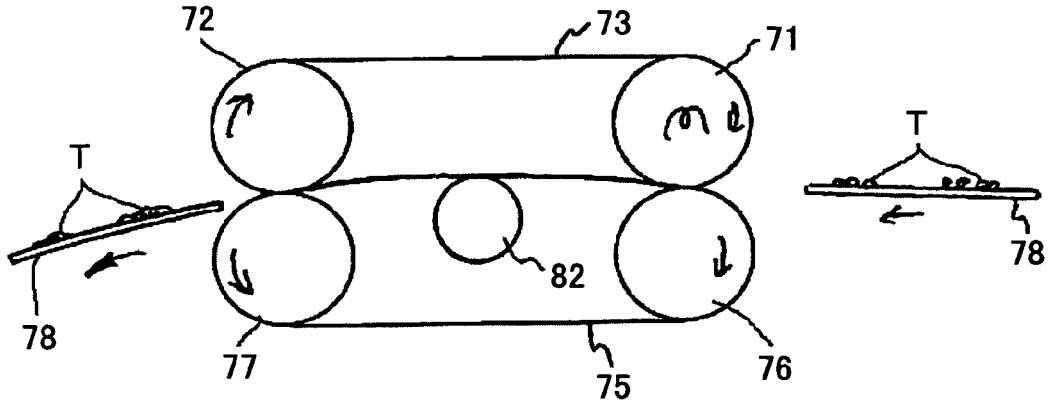
FIG. 15 is a schematic diagram of the fixing apparatus according to Embodiment 8 of the present invention.
Figure 16:
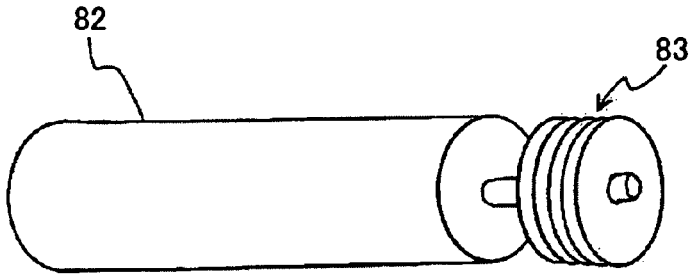
FIG. 16 is a perspective view of a heat pipe used in Embodiment 8.

The fixing apparatus according Embodiment 8 is the same Embodiment 7, except that a heat pipe 82 is used in place of the heat sink 79. The heat pipe 82, diameter of which is 15 mm, serves as the pressurizing member in the conveyance passage as shown in FIG. 15. The outline structure of the heat pipe 82 is shown in FIG. 16. The heat pipe 82 includes a heat dissipation fin 83 for exchanging heat with the open air, and the heat dissipation fin 83 is cooled by the air cooling fan 81 (not illustrated in FIG. 15, but refer to FIG. 12) for enhancing the heat exchange. When the heat pipe 82 is arranged such that the angle α a between the entrance passage and the discharge passage (refer to FIG. 17) becomes 10°, a color photography print having a great size was naturally and almost linearly discharged as shown in FIG. 14, producing a high quality color print without a scratch due to a separation nail.

By making the pressurizing member of a roller-like member as shown in FIG. 15, sliding torque required for driving the belt can be reduced. With this structure, the curvature of the heat pipe 82 pressurizes the belts 73 and 75 from the pressurization belt side, and the recording paper 78 is conveyed being adhered between the belts 73 and 75 without floating or vibrating. In this way, the recording paper 78 is automatically separated from the fixing belt 73 as shown in FIG. 14.

Further, according to the structure shown in FIG. 15, the heat pipe 82 serves as a pressurizing member for pressurizing the belts 73 and 75 from the side of the pressurization belt 75, and for heat exchanging with the open air. Therein, the heat pipe 82 is rotated, while cooling and solidifying the toner image on the recording paper 78 that is conveyed along the curvature, being sandwiched by the belts 73 and 75. In this way, curling to the side of the fixing belt 73 at the time of discharging the recording paper 78 is prevented from occurring, the natural separation being obtained without a separation nail being needed.

Here, the curve of the conveyance way through which the paper 78 is conveyed is set up such that the angle α between the penetration direction A and the discharge direction B, as shown in FIG. 17, falls within a range between 5° and 20°. If the angle α is smaller than 5°, curling of the recording paper 78 cannot be sufficiently reduced. Conversely, if the angle α is greater than 20°, image blur tends to be generated in the conveyance passage. For this reason, the angle α is desired to fall within the range between 5° and 20°, or more preferably between 10° and 15°.

Embodiment 9

Figure 18:
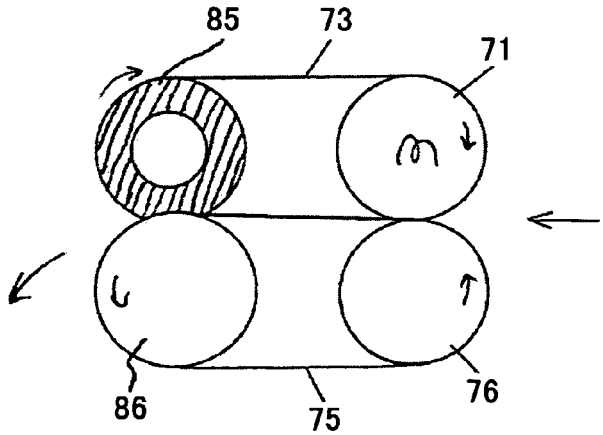
FIG. 18 is a schematic diagram of the fixing apparatus according to Embodiment 9 of the present invention.

The fixing apparatus according to Embodiment 9 as shown in FIG. 18 is the same as Embodiment 7, except that a tension roller 85 is employed in place of the tension roller 72, and that a tension roller 86 is employed in place of the tension roller 77. Here, the tension roller 85 on the side of the fixing belt 73 has a rubber layer, and the tension roller 86 is a heat pipe as shown in FIG. 16 with an aluminum surface. The tension roller 86 bites into the rubber layer of the tension roller 85. When the angle α between the entrance passage and the discharge section, as shown in FIG. 17, was set at 15° with such structure, natural discharge of the recording paper 78 was almost linearly carried out, as shown in FIG. 14, obtaining a high quality color photography print without a scratch due to the separation nail.

That is, according to Embodiment 9, since the tension rollers 85 and 86 cools and solidifies the toner image on the recording paper 78, and incurvates the recording paper 78, the structure of the fixing apparatus is simplified, and the size thereof is miniaturized. Further, curling of the recording paper 78 to the side of the fixing belt 73 at the time of discharge is prevented from occurring, and the recording paper 78 is naturally separated without a separation nail.

Embodiment 10

Figure 19:
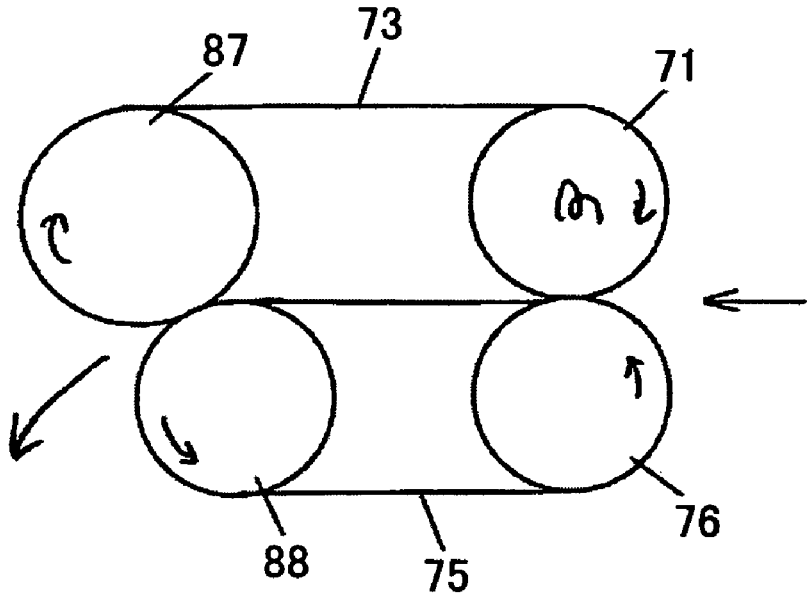
FIG. 19 is a schematic diagram of the fixing apparatus according to Embodiment 10 of the present invention.

The fixing apparatus according to Embodiment 10 is shown in FIG. 19, which is the same as Embodiment 7, except that a tension roller 88 on the side of the pressurization belt 75 is constituted by a heat pipe (as shown in FIG. 16). The surface of the tension roller 88 is of aluminum, and the tension roller 88 counters a tension roller 87 that is on the side of the fixing belt 73. The tension rollers 87 and 88 are arranged with an angle as shown in FIG. 19, and are arranged such that the tension roller 88 bites the fixing belt 73 at a portion where the recording medium 78 is conveyed. When the angle α as defined by illustration of FIG. 17 was made to become 15°, the recording paper 78 of a color photography print was naturally discharged almost linearly as shown in FIG. 14. That is, a high quality color print without a scratch due to the separation nail was obtained. Further, the structure of the fixing apparatus was simplified, miniaturization of the size was attained, curling of the recording paper 78 to the side of the fixing belt 73 at the time of discharge was prevented-from occurring, and even if there is no separation nail, the natural separation of the recording paper 78 was attained.

Embodiment 11

Figure 20:
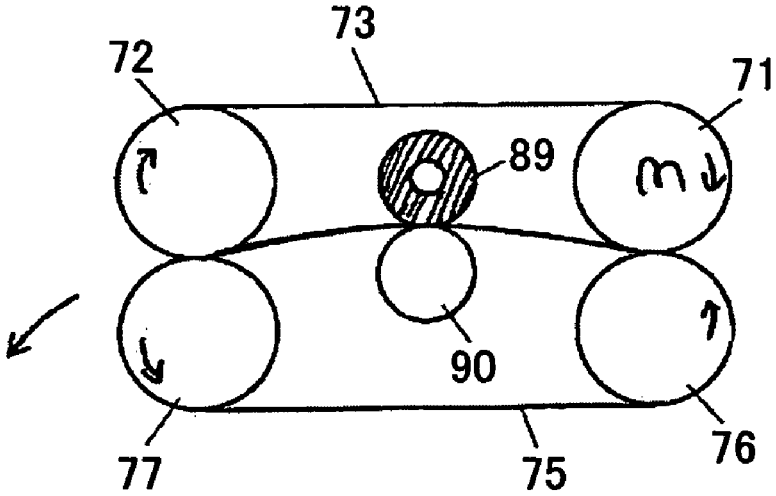
FIG. 20 is a schematic diagram of the fixing apparatus according to Embodiment 11 of the present invention.

The fixing apparatus according to Embodiment 11 is shown in FIG. 20, which is the same as Embodiment 7, except that the former includes a rubber elasticity roller 89, and a heat pipe 90 as shown in FIG. 20, the rubber elasticity roller 89 on the fixing belt 73 side countering the heat pipe 90, such that the conveyance passage is pressurized. A high quality color print without blur was obtained, even if the conveyance passage was curved, and without a scratch due to the separation nail.

That is, by conveying the recording paper 78, which can include an OHP sheet and a thick paper such as a postcard, along the curvature of the structure as described above, the recording paper 78 was stably conveyed, sticking to the faces of the belts 73 and 75 without floating and vibration. Further, the recording paper 78 was naturally discharged in the direction that separates from the fixing belt 73 as shown in FIG. 14. That is, natural separation, dispensing with a separation nail, was attained.

As described above, the fixing apparatus according to the present invention is a low temperature energy-saving fixing system capable of using a low melting point toner, wherein the recording paper is automatically and naturally discharged without curling, dispensing with a separation nail, thereby producing a high quality color print. An image formation apparatus with above features can be structured with the fixing apparatus as described above.

Further, the present invention is not limited to these embodiments, but variations and modifications may be made without departing from the scope of the present invention.

The present application is based on Japanese Priority Applications No. 2005-17669 filed on Jan. 26, 2005, No. 2005-285912 filed on Sep. 30, 2005, and No. 2005-313328 filed on Oct. 27, 2005, with the Japanese Patent Office, the entire contents of which are hereby incorporated by reference.

What is claimed is:

1. A fixing method, comprising steps of:

inserting a recording medium between a pair of belts that are endless;

pressurizing the recording medium only within a nip constituted by a heating roller and a pressurization roller;

conveying the recording medium inserted between the belts by tension of the belts, an image being placed on a surface of the recording medium, the surface being stuck to one of the belts, the one being a fixing belt on the side of the heating roller;

maintaining temperature of the recording medium by sandwiching the recording medium between the pair of the belts, where no forced cooling is provided; and controlling a temperature drop to be within a predetermined range, the temperature drop being a difference between a temperature of the fixing belt when the fixing belt is in contact with the heating roller and a temperature of the fixing belt when the recording medium is separated from the fixing belts, wherein the pair of the belts sandwiches the recording medium by belt tension of between 0.001 and 5.4 N/mm for a period of between 50 and 1000 ms, the recording medium is pressurized at pressure between 0.007 and 2.7 N/mm within the nip constituted by the heating roller and the pressurization roller, and the temperature drop is less than 50° C.

2. The fixing method as claimed in claim 1, wherein a diameter of the pressurization roller is smaller than a diameter of the heating roller, the diameter of the pressurization roller is between 2 and 95% of the diameter of the heating roller, and the diameter of the pressurization roller is between 5 and 150 mm.

3. The fixing method as claimed in claim 1, wherein a heat resistant rubber layer is provided on a surface of the pressurization roller.

4. The fixing method as claimed in claim 3, wherein hardness of the heat resistant rubber layer is between 5 and 80° of JISA.

5. The fixing method as claimed in claim 3, wherein thickness of the heat resistant rubber layer is between 0.05 and 30 mm.

6. The fixing method as claimed in claim 3, wherein the heat resistant rubber layer is covered by a seamless PFA tube.

7. The fixing method as claimed in claim 6, wherein thickness of the PFA tube is between 0.005 and 5 mm.

8. The fixing method claimed in claim 3, wherein a surface of the rubber layer is coated by PFA.

9. The fixing method as claimed in claim 8, wherein thickness of the PFA coating is between 0.01 and 5 mm.

10. The fixing method as claimed in claim 1, wherein an axle of the pressurization roller is made of metal, and the axle is hollow.

11. The fixing method as claimed in claim 1, wherein thickness of each of the pair of the belts is between 30 and 600 μm.

12. the fixing method as claimed in claim 1, wherein the pair of the belts are driven by at least a driving roller that is one of a pair of rollers other than the heating roller and the pressurization roller, one of the belts being wound around the driving roller, and the heating roller and the pressurization roller are rotated as follower rollers.

13. The fixing method as claimed in claim 12, wherein a rubber layer is arranged on a surface of the driving roller.

14. The fixing method as claimed in claim 13, wherein thickness of the rubber layer on the surface of the driving roller is between 0.05 and 30 mm.

15. The fixing method as claimed in claim 12, wherein an axle of the driving roller is made of metal, and the axle is hollow.

16. The fixing method as claimed in claim 1, further comprising:

a temperature maintaining cover for reducing heat dissipation.

17. The fixing method as claimed in claim 1, wherein air is blown onto at least one of the belts.

18. An image formation method, comprising the fixing method as claimed in claim 1.

19. A fixing apparatus, comprising:

a heating roller and a pressurization roller that constitute a nip, whereat a recording medium is pressurized;

a first belt that is endless and wound around the heating roller;

a second belt that is endless and wound around the pressurization roller;

wherein the first belt and the second belt constitute a pair and convey the recording medium by belt tension, sandwiching the recording medium;

wherein a surface of the recording medium that carries an image is stuck to the first belt;

wherein the recording medium is kept warm during the conveyance by being sandwiched by the pair of the belts, without compulsorily being cooled;

wherein a temperature drop of the first belt is set to fall within a predetermined range, the temperature drop being a difference of temperatures of the first belt when contacting the heating roller and when separating the recording medium, wherein the pair of the belts sandwiches the recording medium by belt tension of between 0.001 and 5.4 N/mm for a period of between 50 and 1000 ms, the recording medium is pressurized at pressure between 0.007 and 2.7 N/mm within the nip constituted by the heating roller and the pressurization roller, and the temperature drop is less than 50° C.

20. The fixing apparatus as claimed in claim 19, wherein a diameter of the pressurization roller is smaller than a diameter of the heating roller, the diameter of the pressurization roller is between 2 and 95% of the diameter of the heating roller, and the diameter of the pressurization roller is between 5 and 150 mm.

21. The fixing apparatus as claimed in claim 19, wherein a heat resistant rubber layer is installed on a surface of the pressurization roller.

22. The fixing apparatus as claimed in claim 21, wherein hardness of the heat resistant rubber layer is between 5 and 80° of JISA.

23. The fixing apparatus as claimed in claim 21, wherein thickness of the heat resistant rubber layer is between 0.05 and 30 mm.

24. The fixing apparatus as claimed in claim 21, wherein the heat resistant rubber layer is covered by a seamless PFA tube.

25. The fixing apparatus as claimed in claim 24, wherein thickness of the PFA tube is between 0.005 and 5 mm.

26. The fixing apparatus as claimed in claim 21, wherein a surface of the rubber layer is coated by PFA.

27. The fixing apparatus as claimed in claim 26, wherein thickness of the PFA coating is between 0.01 and 5 mm.

28. The fixing apparatus as claimed in claim 19, wherein an axle of the pressurization roller is made of metal, and the axle is hollow.

29. The fixing apparatus as claimed in claim 19, wherein thickness of each of the pair of the belts is between 30 and 600 μm.

30. The fixing apparatus as claimed in claim 19, wherein the pair of the belts are driven by a driving roller that is one of a pair of rollers other than the heating roller and the pressurization roller, one of the belts being wound around the driving roller, and the heating roller and the pressurization roller are rotated as follower rollers.

31. The fixing apparatus as claimed in claim 30, wherein a rubber layer is arranged on a surface of the driving roller.

32. The fixing apparatus as claimed in claim 31, wherein thickness of the rubber layer on the surface of the driving roller is between 0.05 and 30 mm.

33. The fixing apparatus as claimed in claim 30, wherein an axle of the driving roller is made of metal, and the axle is hollow.

34. The fixing apparatus as claimed in claim 19, wherein a temperature maintaining cover for suppressing heat dissipation is provided.

35. The fixing apparatus as claimed in claim 19, wherein air is blown onto at least one of the belts.

36. An image formation apparatus, comprising the fixing apparatus as claimed in claim 19.

37. The fixing method as claimed in claim 1, wherein an auxiliary member is provided for stabilizing the belts that sandwich the recording medium.

38. The fixing method as claimed in claim 37, wherein the auxiliary member is an auxiliary guide board.

39. The fixing method as claimed in claim 38, wherein an amount of intrusion of the auxiliary guide board is between 0.01 and 10 mm.

40. The fixing method as claimed in claim 38, wherein a surface of the auxiliary guide board contacting the belt is made smooth with a sculptured surface having a first radius of curvature between 200 and 100000 mm as converted to a true circle.

41. The fixing method as claimed in claim 40, wherein both ends of the auxiliary guide board have a second radius of curvature that is smaller than the first radius of curvature.

42. The fixing method as claimed in claim 38, wherein a heat insulation layer is provided on a surface of the auxiliary guide board.

43. The fixing method as claimed in claim 42, wherein the heat insulation layers is made of porous ceramics.

44. The fixing method as claimed in claim 42, wherein the heat insulation layer is made of felt.

45. The fixing method as claimed in claim 43, wherein a protection layer having low friction is provided on the heat insulation layer.

46. The fixing method as claimed in claim 38, wherein surface coarseness of an outermost layer of the auxiliary guide board is between 0.01 and 200 μm in Rz.

47. The fixing method as claimed in claim 38, wherein two or more auxiliary guide boards are alternately provided.

48. The fixing method as claimed in claim 38, wherein the auxiliary guide board touches the belt on a side that is opposite to a fixing side.

49. The fixing method as claimed in claim 38, wherein mass of the auxiliary guide board is 500 grams or less.

50. The fixing method as claimed in claim 38, wherein the auxiliary guide board is affixed through a heat insulation member.

51. An image formation method, comprising the fixing method as claimed in claim 37.

52. The fixing apparatus as claimed in claim 19, wherein an auxiliary member is provided for stabilizing the belts that sandwich the recording medium.

53. The fixing apparatus as claimed in claim 52, wherein the auxiliary member is an auxiliary guide board.

54. The fixing apparatus as claimed in claim 53, wherein an amount of intrusion of the auxiliary guide board is between 0.01 and 10 mm.

55. The fixing apparatus as claimed in claim 53, wherein a surface of the auxiliary guide board contacting the belt is made smooth with a sculptured surface having a first radius of curvature between 200 and 100000 mm as converted to a true circle.

56. The fixing apparatus as claimed in claim 55, wherein both ends of the auxiliary guide board have a second radius of curvature that is smaller than the first radius of curvature.

57. The fixing apparatus as claimed in claim 53, wherein a heat insulation layer is provided on a surface of the auxiliary guide board.

58. The fixing apparatus as claimed in claim 57, wherein the heat insulation layer is made of porous ceramics.

59. The fixing apparatus as claimed in claim 57, wherein the heat insulation layer is made of felt.

60. The fixing apparatus as claimed in claim 58, wherein a protection layer having low friction is provided on the heat insulation layer.

61. The fixing apparatus as claimed in claim 53, wherein surface coarseness of an outermost layer of the auxiliary guide board is between 0.01 and 200 μm in Rz.

62. The fixing apparatus as claimed in claim 61, wherein two or more auxiliary guide boards are alternately provided.

63. The fixing apparatus as claimed in claim 53, wherein the auxiliary guide board touches the belt on a side that is opposite to a fixing side.

64. The fixing apparatus as claimed in claim 53, wherein mass of the auxiliary guide board is 500 grams or less.

65. The fixing apparatus as claimed in claim 53, wherein the auxiliary guide board is affixed through a heat insulation member.

66. An image formation apparatus, comprising the fixing apparatus as claimed in claim 52.

* * * * *